US007090020B2

(12) United States Patent
Hill et al.

(10) Patent No.: US 7,090,020 B2
(45) Date of Patent: Aug. 15, 2006

(54) MULTI-CYCLE DUMP VALVE

(75) Inventors: Stephen D. Hill, Pearland, TX (US); Robert Bucher, Houston, TX (US); L. Michael McKee, Friendswood, TX (US); Mark C. Oettli, Richmond, TX (US); Michael G. Gay, Dickinson, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 188 days.

(21) Appl. No.: 10/671,275

(22) Filed: Sep. 25, 2003

(65) Prior Publication Data

US 2004/0084190 A1 May 6, 2004

Related U.S. Application Data

(60) Provisional application No. 60/422,285, filed on Oct. 30, 2002.

(51) Int. Cl.
*E21B 34/06* (2006.01)

(52) U.S. Cl. ..... 166/373; 166/386; 166/191

(58) Field of Classification Search ..... 166/373, 166/386, 191, 142, 145, 184–186
See application file for complete search history.

(56) References Cited

U.S. PATENT DOCUMENTS

| | | | | |
|---|---|---|---|---|
| 6,209,663 | B1 * | 4/2001 | Hosie | 175/57 |
| 6,776,239 | B1 * | 8/2004 | Eslinger et al. | 166/308.1 |
| 2002/0062963 | A1 * | 5/2002 | Eslinger et al. | 166/308 |
| 2004/0084187 | A1 * | 5/2004 | Costley et al. | 166/312 |

* cited by examiner

*Primary Examiner*—William Neuder
(74) *Attorney, Agent, or Firm*—Tim Curington; Robin Nava; Dale Gaudier

(57) ABSTRACT

A flow responsive dump valve mechanism for a straddle packer tool and has a valve controlled flow passage from which underflushed fluid, typically well treatment slurry, in a conveyance and fluid supplying tubing string can be dumped into a well casing. The dump valve mechanism incorporates a ratcheting power piston, an indexing mechanism and high and low load energy storage systems to accomplish open, closed and intermediate dump valve positions. The intermediate position increases the functionality of the tool by preventing accidental closure either due to the free fall of fluid through the coiled tubing or during flushing of the tool and permits the flow rate to be increased for thorough cleaning of the straddle tool and coiled tubing. For energy storage, a light compression spring provides power to cycle the indexing mechanism. Heavier load disc springs (Bellville Washers) are used to provide power for the ratcheting power piston to open the valve.

15 Claims, 18 Drawing Sheets

MULTI-CYCLE DUMP VALVE

RELATED INVENTION

The present invention relates to the subject matter of commonly assigned U.S. Patent Publication No. US 202/0062963 A1, of David M. Eslinger et. al, published on May 30, 2002, and issued as U.S. Pat. No. 6,533,037 on Mar. 18, 2003, which Publication and Patent are incorporated herein by reference for all purposes. Applicants hereby claim priority in U.S. Provisional Application No. 60/422,285, filed on Oct. 30, 2002 by Stephen D. Hill, Robert Bucher, L. Michael McKee, Mark Oettli and Michael Gay and entitled "Dump Valve" and incorporate said Provisional Application by reference herein for all purposes.

BACKGROUND OF THE INVENTION

1. Field of the Invention

The present invention relates generally to straddle tools for use in wellbores for stimulation or fracturing of packer isolated annulus intervals and more particularly to straddle tools having valves that are actuated to cause dumping into the well below the straddle tool fluids from a conveyance and injection tubing string, from the straddle tool and from the annulus interval being treated. More particularly, the present invention concerns valves are operated by flow and controlled by indexing to accomplish selected valve positioning to provide for interval treatment and to provide for dumping of treatment fluid from a tubing string, from the straddle tool and from the annulus intervals upon completion of well interval treatment and to prevent flow responsive valve movement under certain conditions.

2. Description of the Prior Art

After a wellbore is drilled, various completion operations are performed to enable production of well fluids. Examples of such completion operations include the installation of casing, production tubing, and various packers to define zones in the wellbore. Also, a perforating string is lowered into the wellbore and fired to create perforations in the surrounding casing and to extend perforations into the surrounding formation.

To further enhance the productivity of a formation, fracturing may be performed. Typically, fracturing fluid is pumped into the wellbore to fracture the formation so that fluid flow conductivity in the formation is improved to provide enhanced fluid flow into the wellbore. Enhancement of well production is also achieved by chemical treatment, such as acidizing, through the use of similar well treatment straddle packer tools.

A typical fracturing string includes an assembly carried by tubing, such as coiled tubing or jointed tubing, with the assembly including a straddle packer tool having sealing elements to define a sealed annulus interval between the assembly and the well casing into which fracturing fluids can be pumped. The well casing of sealed or isolated annulus interval is perforated for communication with the surrounding formation. The fracturing fluid is pumped down the tubing and through one or more ports of the straddle packer tool into the sealed annulus interval.

After the fracturing operation has been completed, clean-up of the wellbore and coiled tubing is performed by pumping fluids down an annulus region between the coiled tubing and casing. The annulus fluids push debris (including fracturing proppants) and slurry present in the interval adjacent the fractured formation and in the coiled tubing back out to the well surface. This clean-up operation is time consuming and is expensive in terms of labor and the time that a wellbore remains inoperable. By not having to dispose of slurry, returns to surface are avoided along with their complicated handling issues. More importantly, when pumping down the annulus between coiled tubing and the wellbore, the zones above the treatment zone can be damaged by this clean-out operation. Further, under-pressured zones above the straddled zone can absorb large quantities of fluids. Such losses may require large volumes of additional fluid to be kept at surface for the sole purpose of clean-up. An improved method and apparatus is thus needed for performing clean-up after a fracturing operation has been completed.

Prior well treatment tool designs involved the use of a well treatment and slurry removal tool that could only open or close; and with no intermediate positions between the open and closed positions. This tool used a pressure drop across an orifice to load a compression spring to close the valve. Once closed, differential pressure between tubing pressure and wellbore annulus below the treated zone keeps the valve closed. Reduction of that differential pressure across the valve allows the tool to open. However, this severely limits the application and usage of this tool in demanding well conditions. For instance, in order to use this device in wells with low bottom hole pressures, a large spring is used. However, a high flow rate is needed to close the tool with this large spring. This proved to be a problem due to many reasons. Also, this design does not allow operation in wells with bottom-hole pressures below a certain value and fracture gradients below a certain value.

SUMMARY OF THE INVENTION

It is a principal feature of the present invention to provide a novel straddle tool having spaced packer elements for sealing within a well casing and thus isolating a typically perforated casing interval and incorporating a dump valve mechanism that is closed responsive to fluid flow of a selected rate to permit treatment of the annulus interval and is opened to its normal position for discharge of fluid from fluid injection and tool conveying tubing, from the straddle tool and from the annulus interval into the well below the straddle tool.

It is another feature of the present invention to provide a novel straddle tool having flow responsive J-slot indexing mechanisms permitting flow responsive setting of the position control mechanism of the straddle tool in a number of differing operational positions, including a full open position, a closed position.

In general, in accordance with an embodiment of the present invention, a tool for use in a wellbore comprises a flow conduit through which fluid flow can occur and a valve assembly adapted to be actuated between an open and closed position in response to fluid flow at greater than a predetermined rate.

Briefly, according to the principles of the present invention, an indexing flow actuated, differential pressure operated tubing conveyed tool is provided to accomplish a desired well treatment, such as formation fracturing, stimulation chemical treatment, proppant slurry injection, etc., and to accomplish treatment fluid removal from the tubing, tool and straddled annulus interval after well treatment activity has been completed. The tool is conveyed within a wellbore, including highly deviated or horizontal wellbores, on a tubing string composed of coiled-tubing, or conventional jointed tubing. A dump valve and valve indexing tool is connected to the downhole well treatment straddle tool and is used to either remove the under flushed volume of slurry left in the coiled tubing after placing the proppant in a perforation or to remove the entire volume of slurry left in the coiled tubing after a screen-out has taken place. Typically, the device can be used in wells that cannot support reverse circulation, but can easily be used in wells that can support a full column of fluid.

Since the tool is flow actuated, coiled tubing movement is not required to cycle the device between its operative positions. The cycling of the tool, the closing flow rate, and the opening differential pressure are adjustable based on selection of orifice size, diameter of the closure seal and the length of closure seal engagement.

The device is attached below the abrasive slurry delivery device. The mechanism is controlled from the surface with hydraulic flow rate and differential pressure. The tool can be reset with a stored energy source such as a spring, which allows the tool to return to a starting position. The first mechanism is called a J-slot. The J-slot mechanism is attached to a mandrel. The J-slot mechanism prevents the primary valve (part of the mandrel) from closing in one position and allows the primary valve to close in a second position. The second mechanism is a ratcheting power piston that connects to a large force stored energy device.

The indexing controlled dump valve tool permits flushing of under-displaced slurry from the coiled tubing, without reverse circulation, below the lower element. Flushing through the coiled tubing is preferred to reverse circulation because it prevents the siphoning of flush fluid by low energy zones above the upper packer and averts any subsequent low energy zone damage. In addition, flushing a small volume of under flushed slurry below the tool can normally be accomplished in significantly less time than reverse circulating the entire volume of the conveyance piping to surface. The multi-position flow operated dump valve mechanism of the present invention is not limited by low frac gradients and thus has the capability of staging, i.e., operation across a perforated interval and is capable of use over the complete length or depth of a wellbore without any requirement for component changes at different depths. The dump valve tool has the capability for operation in various downhole conditions, such as deep zones with high differential opening pressures, and shallow zones having low differential opening pressure without component changes. The dump valve tool of the present invention incorporates an operational concept that permits closing the valve against the force of a light spring and using the force of a high force spring to open the valve. Additionally, the present invention employs a J-slot type indexing mechanism to accomplish selection of various operational positions of the tool.

This indexing controlled dump valve tool uses an indexing system which permits the tool to cycle between an open and a closed condition dependent on the position of the indexing mechanism and differential pressure across the tool.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is a schematic illustration of a well having a well casing with perforations for communication with a subsurface zone and showing a straddle packer well servicing tool in operational position therein and having a dump valve according to the principles of the present invention;

FIGS. 2–6 are simplified schematic illustrations in cross-section, showing the various operational positions of the flow responsive indexing controlled dump valve mechanism of the present invention;

FIGS. 7A-1, 7A-2, 7B-1 and 7B-2 are longitudinal sectional views respectively showing upper and lower sections of the flow responsive indexing controlled dump valve mechanism of the present invention and illustrating the relative positions of the components of the dump valve mechanism in the open condition of the dump valve mechanism;

Figure 12A:
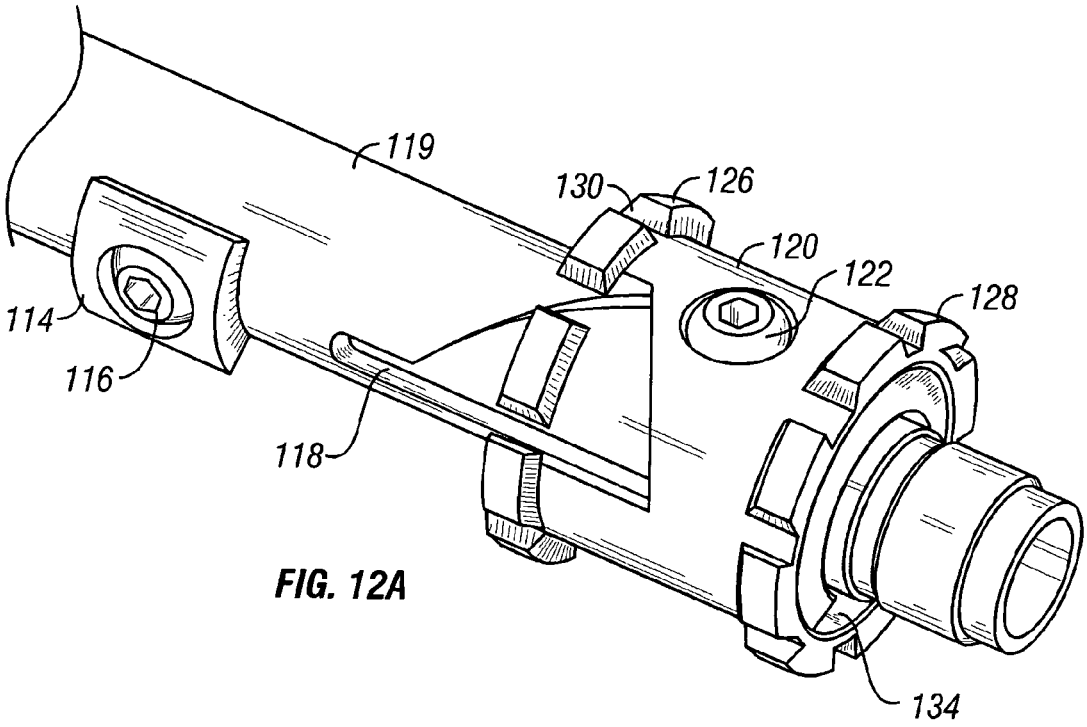
Figure 12B:
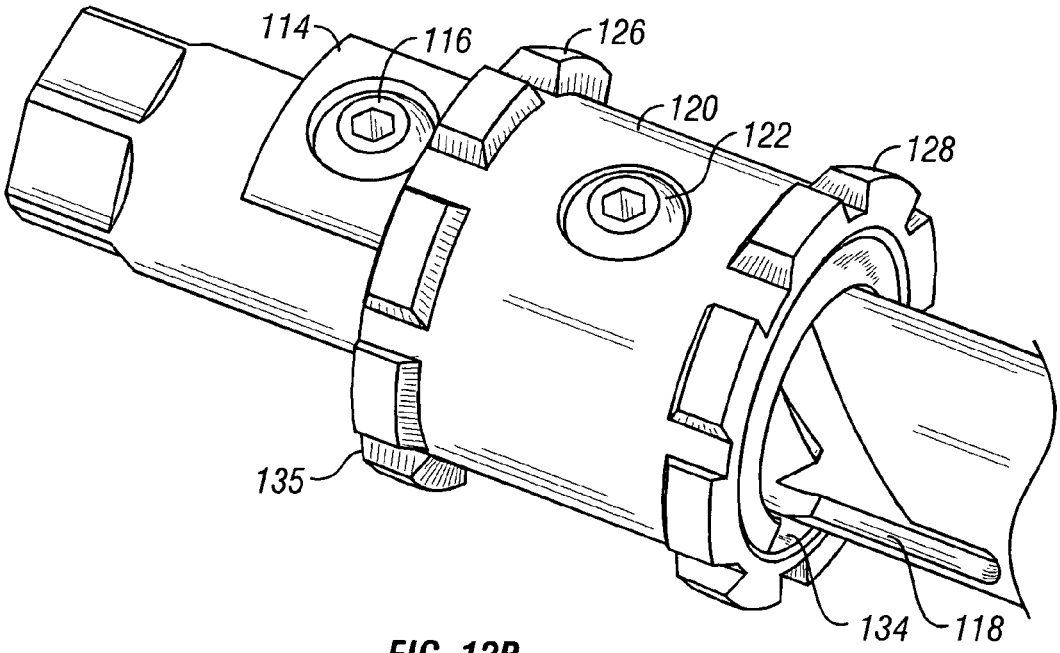
Figure 12C:
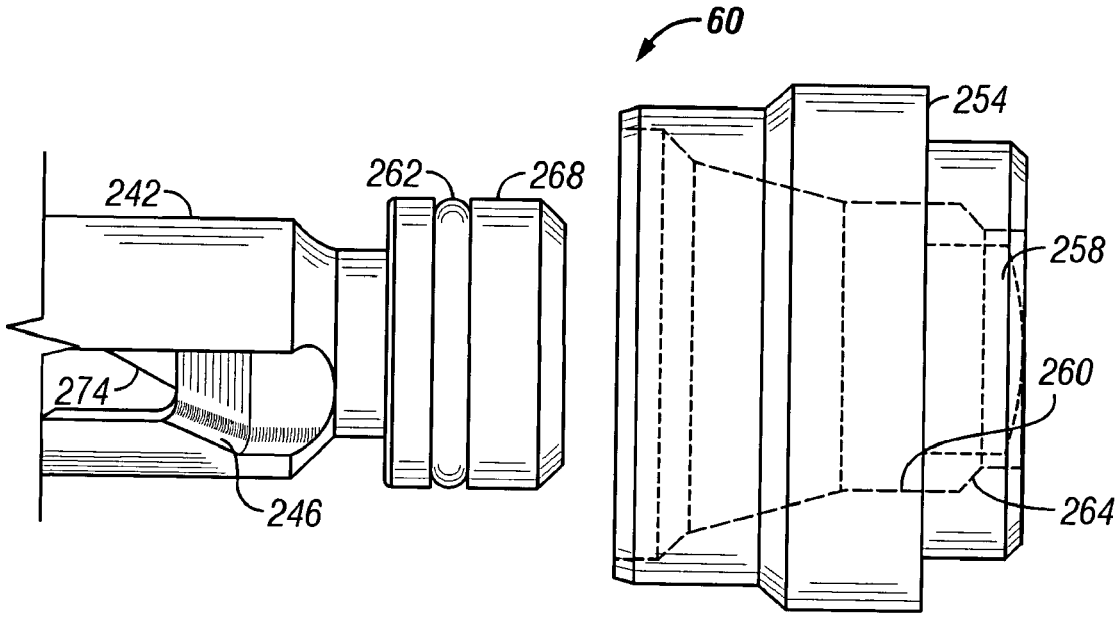
Figure 13:
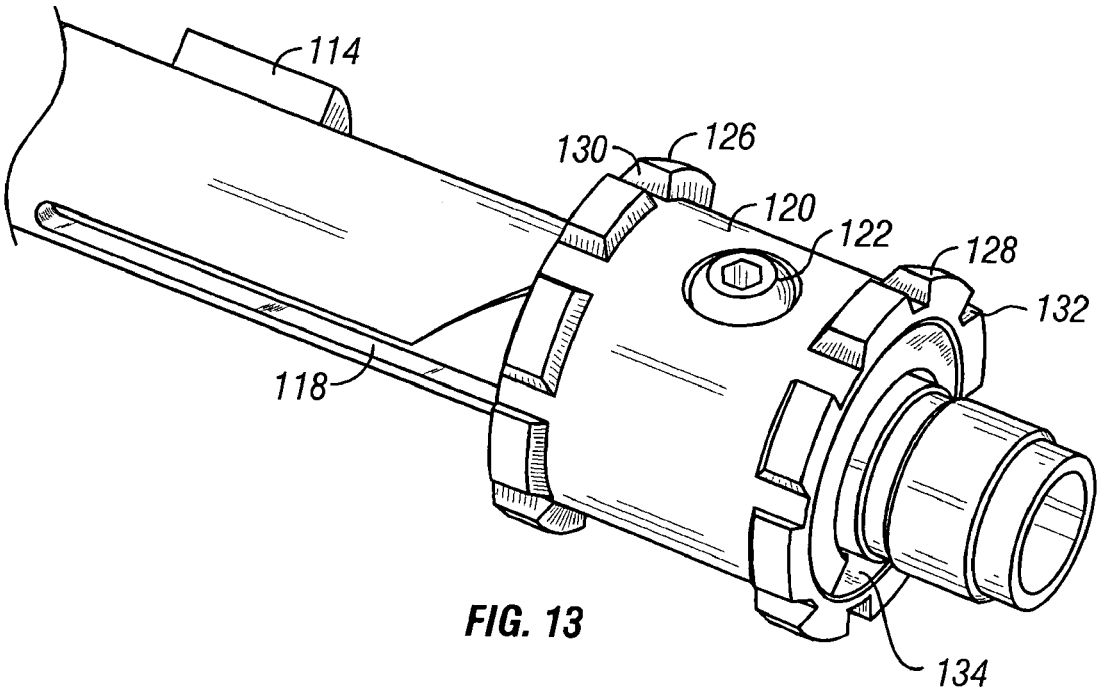
Figure 14A:
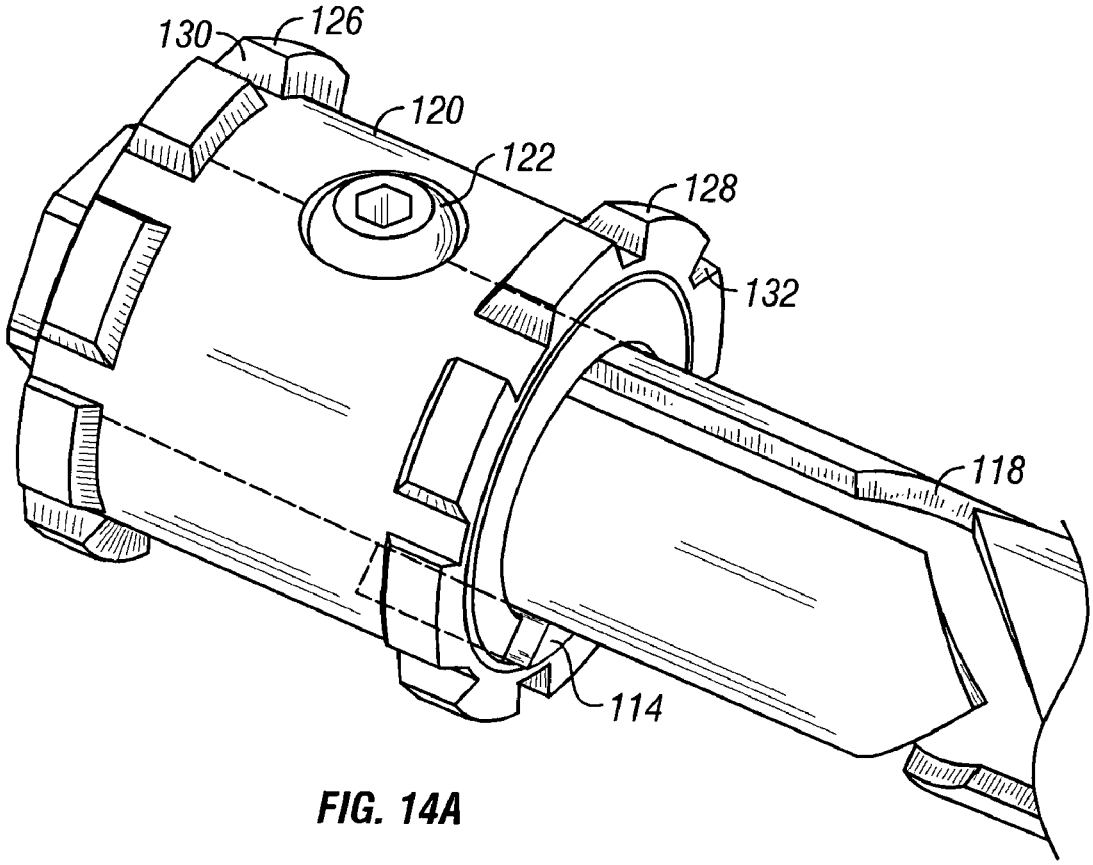
Figure 14B:
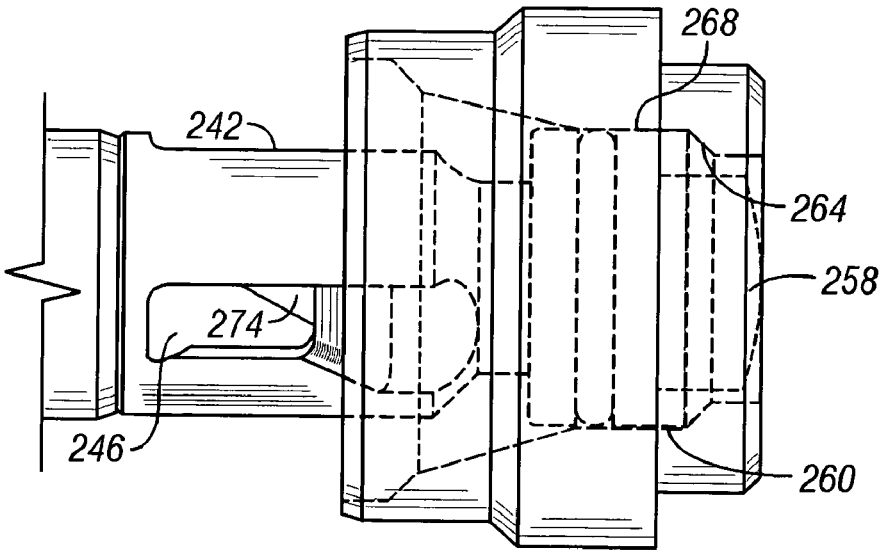
Figure 15:
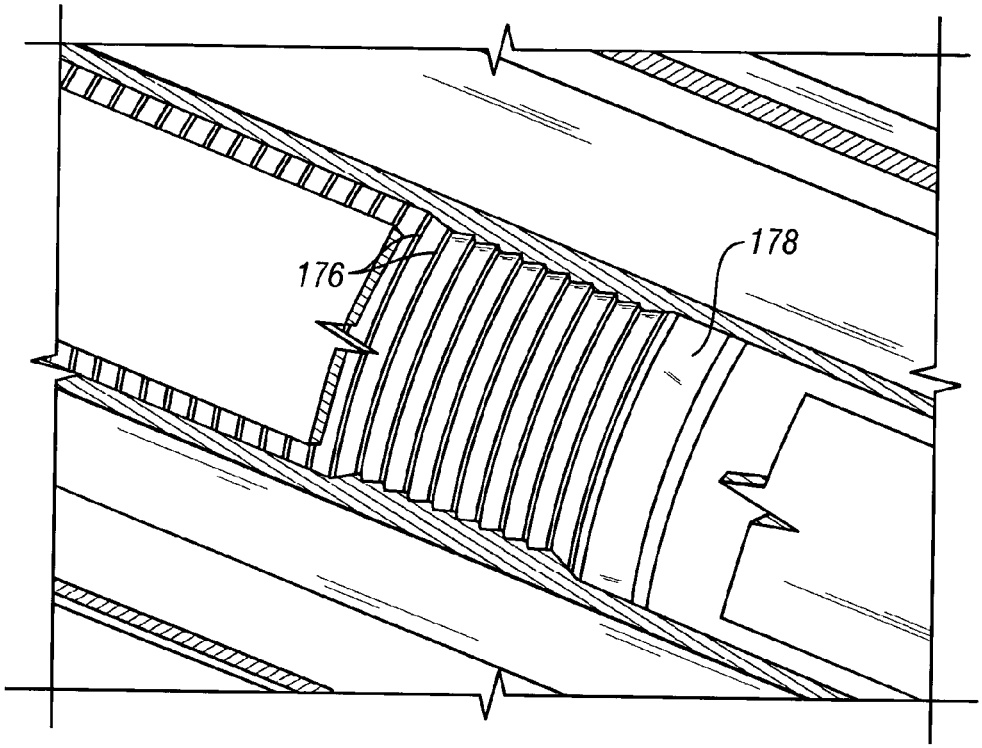
Figure 16:
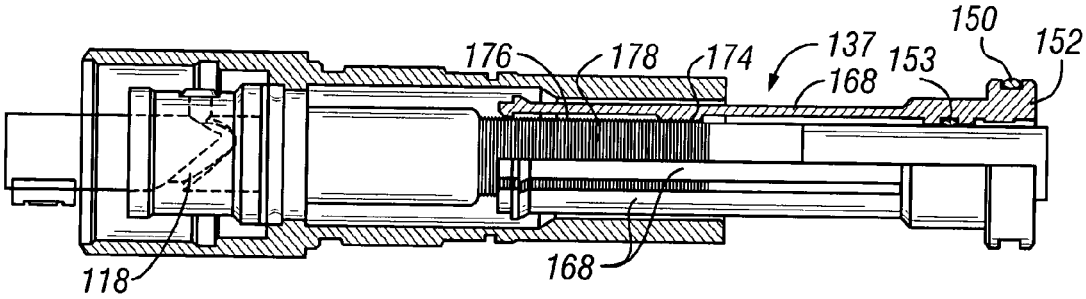
Figure 17:
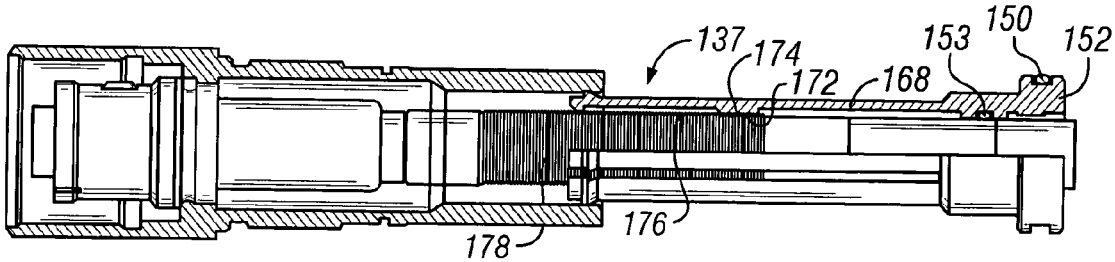
Figure 18A:
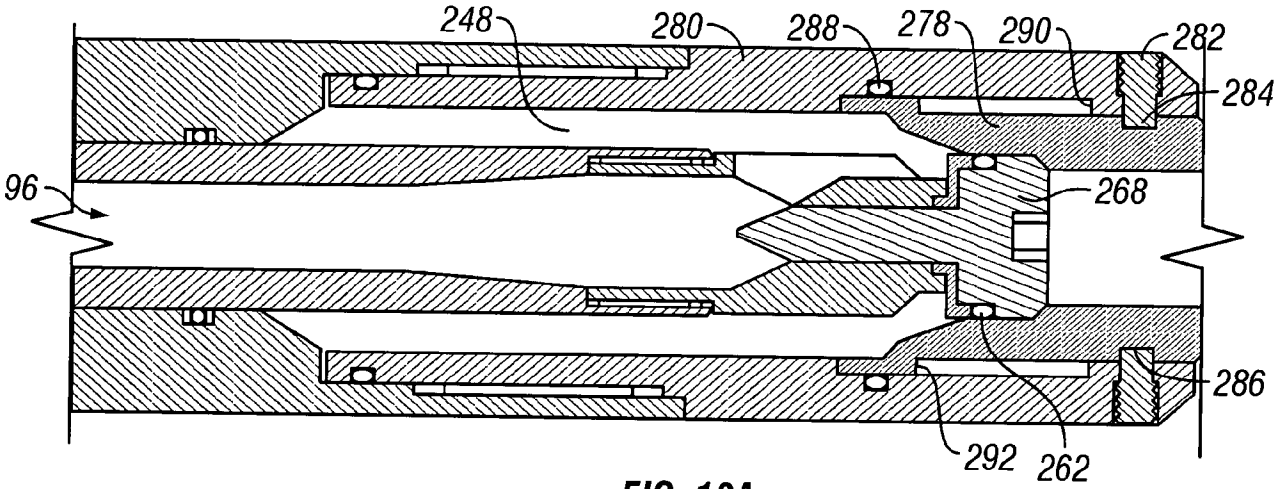
Figure 18B:
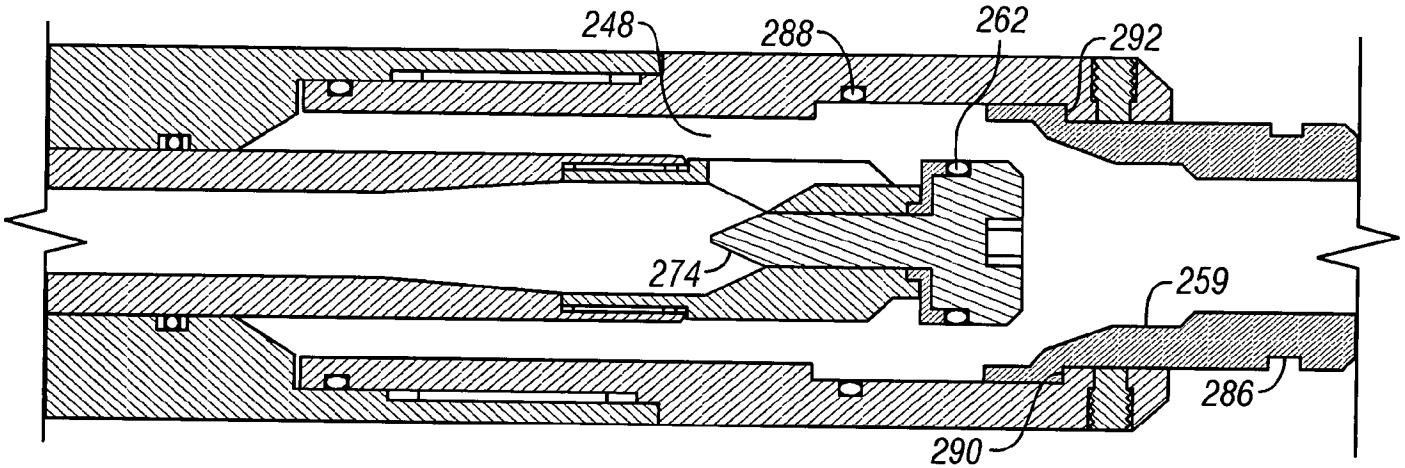

FIGS. 8A-1, 8A-2, 8B-1, and 8B-2 through 11A-1, 11A-2, 11B-1 and 11B-2 are longitudinal sectional views of upper and lower sections of the flow responsive indexing controlled dump valve mechanism shown in FIGS. 7A-1, 7A-2, 7B-1 and 7B-2 and showing the flow responsive indexing controlled dump valve mechanism of the present invention in various other operational positions thereof;

FIG. 12A is an isometric illustration of a portion of the indexing mechanism of the flow responsive indexing controlled dump valve tool of the present invention, showing the "starting position" of the operational sequence thereof;

FIG. 12B is an isometric illustration similar to that of FIG. 12A and showing the J-slot indexing mechanism at its operational Position or sequence 2, preventing flow responsive closing of the valve mechanism;

FIG. 12C is an isometric illustration similar to that of FIGS. 12A and 12B and showing the open position of the valve mechanism when the J-slot indexing mechanism is at operational Position 2;

FIG. 13 is an isometric illustration of a portion of the indexing mechanism of the flow responsive indexing controlled dump valve tool of the present invention, showing the J-slot indexing mechanism at Position 3 of the operational sequence thereof, with the J-slot indexing mechanism at the top of its stroke and ready to close;

FIG. 14A is an isometric illustration showing a portion of the indexing mechanism in "Position 4",illustrating indexing lug passage through the J-sleeve, permitting the valve mechanism to close;

FIG. 14B is a longitudinal cross-sectional further illustrating the closed position of the valve at "Position 4" of the indexing control sequence;

FIG. 15 is an isometric illustration showing the buttress thread detail of the ratcheting collet of the indexing mechanism;

FIG. 16 is an isometric illustration of an alternative embodiment of the present invention, showing the ratcheting collet of the indexing mechanism functioning as a cantilever collet;

FIG. 17 is an isometric illustration of an alternative embodiment showing the ratcheting collet of the indexing mechanism functioning as a bowspring collet;

FIG. 18A is a longitudinal sectional view of a portion of the dump valve mechanism of the present invention, showing an over-pressure relief valve seat in the normal operating position thereof; and FIG. 18B is a longitudinal sectional view similar to that of FIG. 18A and showing the over-pressure relief valve seat in its pressure relieving position after over-pressure responsive shearing of the shear pin retainers thereof.

DETAILED DESCRIPTION OF PREFERRED EMBODIMENT

In the following description, numerous details are set forth to provide an understanding of the present invention. However, it will be understood by those skilled in the art that the present invention may be practiced without these details and that numerous variations or modifications from the described embodiments may be possible. For example, although reference is made to a fracturing string in the described embodiments, other types of tubing conveyed downhole well tools may be employed in further embodiments.

As used here, the terms "up" and "down"; "upward" and downward"; "upstream" and "downstream"; and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate. The terms "tubing" or "coiled tubing" are intended to identify any type of tubing string, such as coiled tubing or conventional jointed tubing which extends from the surface and is utilized to convey the well treatment tool within the well and to supply the well treatment tool with pressurized fluid for an intended well treatment operation. The terms "fracturing" or "well treatment" are intended to identify a range of well treatment operations, such as formation fracturing, fracture propping, acidizing, and the like that are carried out through the use of a downhole straddle tool having spaced packers for isolation of a casing interval and for conducting well treatment activities within the isolated casing interval.

Figure 1:
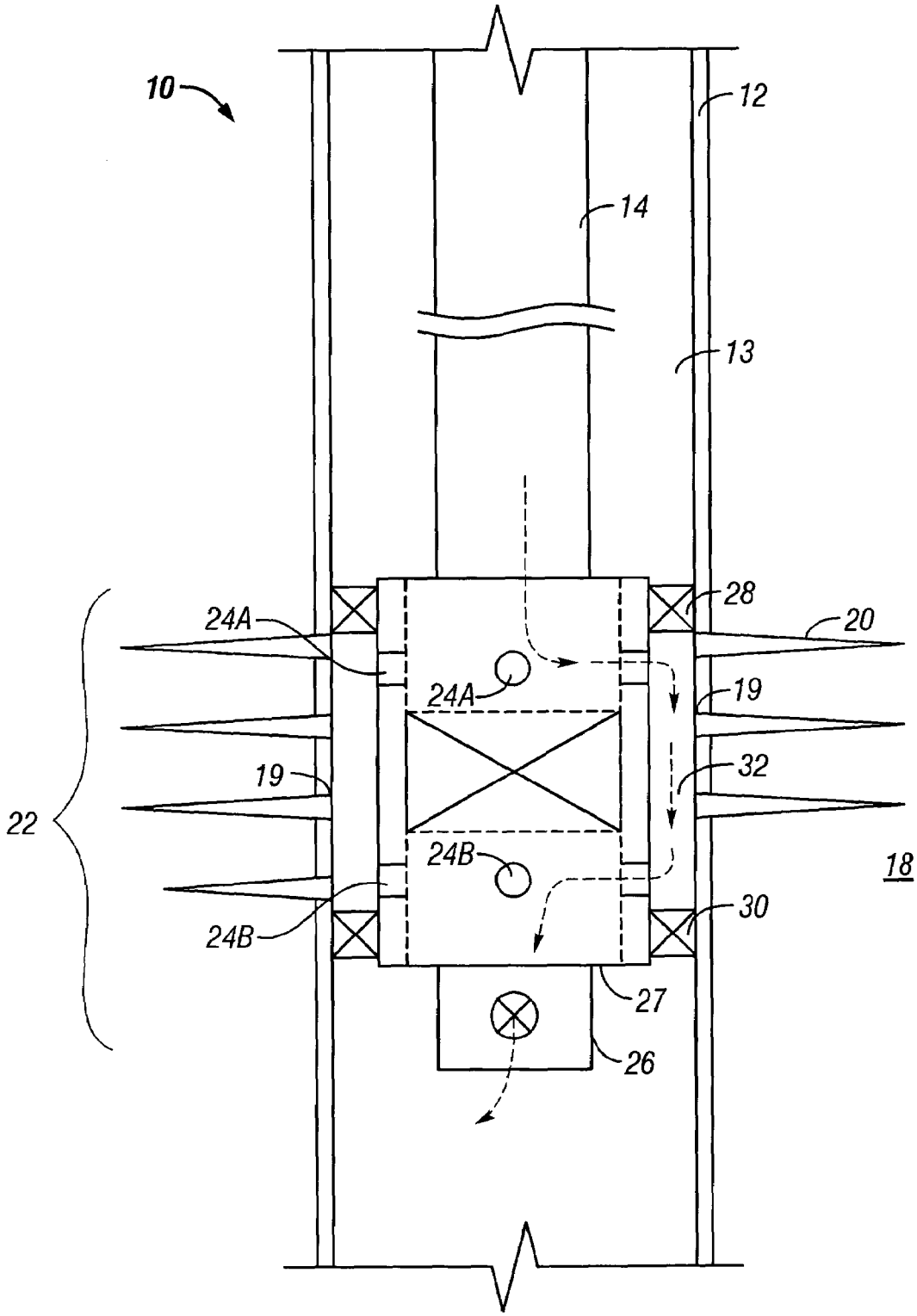

Referring now to the drawings and first to FIG. 1, a tool string in accordance with an embodiment of the present invention is positioned in a wellbore 10. The wellbore 10 is lined with casing 12 and extends through a subsurface formation 18, such as a formation from which petroleum products are produced. The casing 12 has been perforated at 19, such as by detonating perforation explosive charges to form perforations 20 that penetrate through the casing and into the surrounding formation. To perform a fracturing operation, a straddle packer tool 22 carried on a tubing 14 (e.g., a continuous tubing such as coiled tubing or jointed tubing) is run into the wellbore 10 to a depth adjacent the perforated formation 18. The straddle packer tool 22 includes upper and lower sealing elements (e.g., packers) 28 and 30. When set, the sealing elements 28 and 30 define a sealed annulus zone or casing interval 32 surrounding the housing of the straddle packer tool 22. The sealing elements 28 and 30 are carried on a ported sub 27 that has one or more "out" ports 24A through which fluid flows to enable communication of fracturing or other well treatment fluids pumped down the coiled tubing 14 to the sealed annulus zone or casing interval 32 and "in" ports 24B through which treatment fluid from the casing interval 32 flows into the tool for dumping via the dump valve 26.

In accordance with some embodiments of this invention, a dump valve 26 is connected below the ported sub 27. During a fracturing or other well treatment operation, the dump valve 26 is in the closed position so that fluids that are pumped down the coiled tubing 14 flow out through the one or more ports 24A of the ported sub 27 and into the sealed annulus region 32 and from the sealed annulus region flow through casing perforations into the surrounding formation 18. After the fracturing or other well treatment operation has been completed, the dump valve 26 is opened to dump or drain slurry and debris that remains in the sealed annulus region 32 and that is present in the coiled tubing 14. Clean fluid is pumped down the coiled tubing 14 and displaces the slurry out port 24A, down the annulus 32, in through the ports 24B and out through the dump valve 26 to the casing below the dump valve. The dump valve mechanism is arranged to dump fluid into a region of the wellbore 10 below the tool string. By using the dump valve 26 in combination with tubing string fluid supply, the current practice of pumping relatively large quantities of fluid down the annulus 13 between the coiled tubing 14 and the casing 12 to perform treatment fluid clean-up can be avoided. The relatively quick dumping mechanism provides for quicker and more efficient clean-up operations, resulting in minimized costs and improved operational productivity of the well.

Furthermore, in accordance with some embodiments of the present invention, the dump valve 26 is associated with an indexing type valve operating mechanism that is controlled by fluid flow from the coiled tubing 14 to the straddle packer tool 22. When fracturing fluid flow is occurring, the dump valve 26 remains in the closed position to prevent communication of fracturing fluid into the wellbore 10 and to ensure that fluid pressure in the casing interval remains optimum for the character of treatment that is intended. However, before fracturing fluid flow begins (such as during run-in) and after a fracturing operation has been completed and the fracturing fluid flow has been stopped, the dump valve 26 is opened.

By employing a valve operator mechanism that is controlled by fluid flow rather than mechanical manipulation from the well surface, a more convenient valve operating mechanism is provided. A further advantage is that valve operation is effectively automated in the sense that the dump valve is automatically closed once a fluid flow of greater than a predetermined rate is pumped and the dump valve is open otherwise.

Referring now to FIGS. 2–6, the simplified schematic illustrations show the various operational positions of the flow responsive indexing dump valve mechanism from Position 1, the starting position, with the valve open, through Position 5. It should be borne in mind that, for purposes of simplicity and to facilitate ready understanding of the operational sequences or positions of the dump valve mechanism, the J-slot type indexing mechanism of the dump valve tool of the present invention is not shown in FIGS. 2–6. The J-slot type indexing mechanism is shown in detail in FIGS. 7A and 7B through 11A and 11B and is shown by isometric and cross-sectional illustrations in FIGS. 12–14B. The ratcheting collet portion of the indexing mechanism is shown schematically in FIGS. 2–6 and is shown in detail in FIGS. 15–17. An over-pressure relief mechanism to ensure opening of the dump valve in the event of excess internal tool pressure is shown in FIGS. 18 and 18A.

Figure 2:
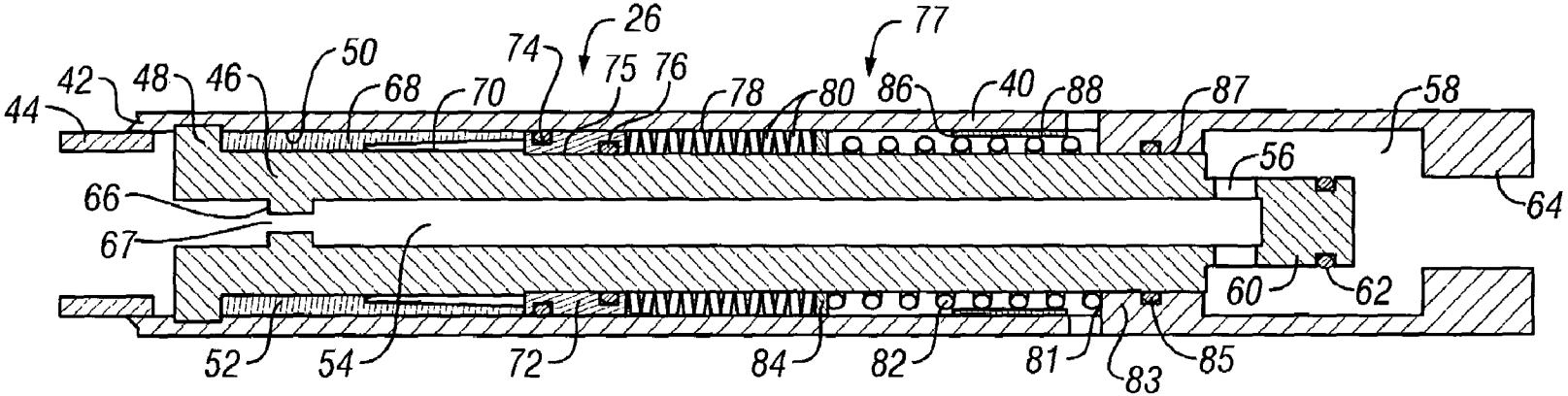

Referring again to FIGS. 2–6, a flow responsive, indexing controlled dump valve mechanism is shown generally at 26 and has a tubular valve body 40 having an upper end portion 42 that is adapted in any suitable manner for mounting to a straddle packer well treatment tool having a portion thereof shown at 44. Within the tubular valve body 40 a tubular valve operating mandrel 46 is supported for flow responsive linear movement and is provided with an upper end flange 48 that maintains guiding, but not sealing engagement with the inner cylindrical surface 50 of the tubular valve body 40 and centralizes the tubular valve operating mandrel 46 within the tubular valve body 40 and thus defines an annulus 52 between the tubular mandrel and the tubular valve body. The tubular valve operating mandrel 46 also defines a central flow passage 54 having fluid communicating intersection with one or more transverse passages 56 from which fluid is discharged into an internal chamber 58 of the valve mechanism. The lower end of the tubular valve operating mandrel 46 is provided with a valve member 60 having one or more seals 62 for sealing with a valve seat 64 when the valve member is moved to the closed position thereof. When the valve member 60 is located at its open position (Position 1), as shown in FIG. 2 pressurized fluid within the flow passage 54 is discharged into the internal chamber 58 from the transverse passage 56. The internal chamber 58 is in communication with well annulus pressure when the valve member is at its open position.

The tubular valve operating mandrel 46 has at least one restriction member 66 located within the central flow passage 54 and providing an orifice 67 having a cross-sectional orifice area (A1) through which fluid must pass as it flows from the tubing string and straddle packer tool through the dump valve mechanism 26 and into the well casing below the dump valve.

During fluid flow through the central passage 54 of the dump valve mechanism a pressure drop is developed across the orifice 67, thereby establishing a differential pressure ($P_{inside}-P_{annulus}$) which acts across the differential area ($A_3-A_1$) and the differential area ($A_2-A_3$).

Within the tubular valve body 40 is located a release sleeve member 68 which is disposed for collet releasing engagement by a ratcheting collet member 70 that is fixed to a power piston member 72 and thus is moveable within the annulus 52 by the power piston member. The power piston member 72 is of annular configuration and is provided with piston seals 74 and 76 that respectively engage the inner peripheral surface 50 of the valve body and the outer peripheral surface 75 of the tubular mandrel 46 and define respective annular pressure responsive piston areas ($A_2$) and ($A_3$).

Within the annulus 52, below the power piston 72, a dual energy storage system, shown generally at 77, is provided with a first energy storage device 78 that is located within the annulus and establishes force transmitting relation with the power piston member 72. The first energy storage device 78 is preferably in the form of a spring package having a plurality of high load disk spring elements 80. A second energy storage device 82 is located within the annulus 52 below the first energy storage device 78 and is separated from the first energy storage device by an annular force transmitting spacer or follower member 84. Preferably, the second energy storage device 82 is provided in the form of a coil spring, but it may conveniently take the form of any of a number of energy storage devices that are mentioned herein. The lower end of the coil spring 82 is supported by an annular support shoulder 81 of an annular guide and support member 83 of the valve housing 40. An annular seal member 85 maintains sealing with a cylindrical outer surface 87 of the tubular valve operating mandrel 46 and thus maintains a sealed relationship between the tubular mandrel and the valve body during relative movement of the tubular mandrel within the valve body. The circular cross-sectional area ($A_4$) of the tubular valve operating mandrel 46 at the location of the annular seal member 85 represents a pressure responsive area that is exposed to well annulus pressure. Another circular cross-sectional area ($A_5$) is defined by the circular internal valve seat surface 64.

The energy storage devices currently used in the dump valve tool and as shown in the drawings are springs, but they could conveniently take the form of gas or nitrogen chambers, lithium batteries, pulses of energy sent from the surface, etc. Also in addition to the dual energy storage system 77, time delay chambers can be added to the system to minimize the size of the energy storage device or to increase the stability of the system by causing the device to require more time for actuation to predetermined positions. The time delay chambers could include orifices, visco-jets, a seal assembly on a piston that slides from a close fit bore to an open or loose fit bore, etc.

The guiding and non-sealing relationship of the upper end flange 48 of the tubular mandrel with the inner cylindrical surface 50 of the valve housing 40 permits the presence within the annulus 52 of fluid pressure from above the restriction member 66, which fluid pressure acts on the pressure responsive differential surface area ($A_2-A_3$) of the annular sleeve-like power piston 72. The differential pressure applied to the differential area ($A_3-A_1$) generates a force that moves the mandrel downward and also transfers the force through an interference shoulder 73 to the power piston 72. The differential pressure also acts on the power piston ($A_2-A_3$) and generates a force which is transferred by the power piston to the high load disc springs 78–80. The disc springs transfer the load of the power piston to the lighter compression spring 82. At the time the low load coil spring is being compressed by the heavier disk spring package, it should be noted that the disk springs undergo only minimal force responsive flexing if any.

Figure 3:
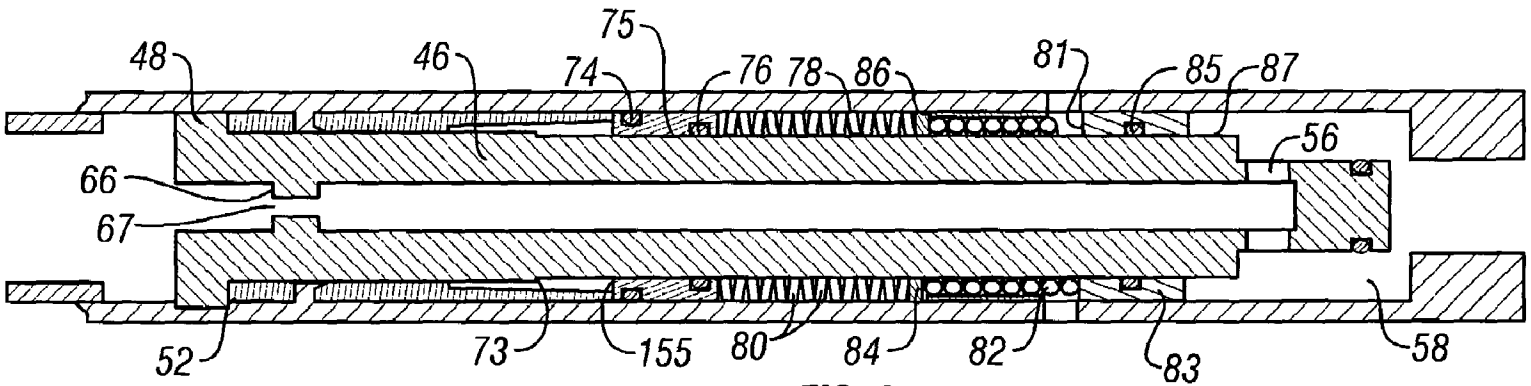

Referring to FIG. 3 of the Drawings, the schematic illustration that is shown depicts Position 2 of the dump valve operational sequence, wherein pump pressure acting across the orifice 67 establishes a differential pressure acting to move the power piston 72 and the ratcheting collet member 70 downwardly. This downward movement of the power piston 72, causes power piston force acting through the high load first energy storage device 78 to achieve complete compression of the lower load second energy storage device 82. Compression of the second energy storage device 82, which has a lower load capacity, is limited by engagement of the annular spacer or follower 84 with an annular spring stop 86 which is defined by the upper end of a tubular stop sleeve 88.

Figure 4:
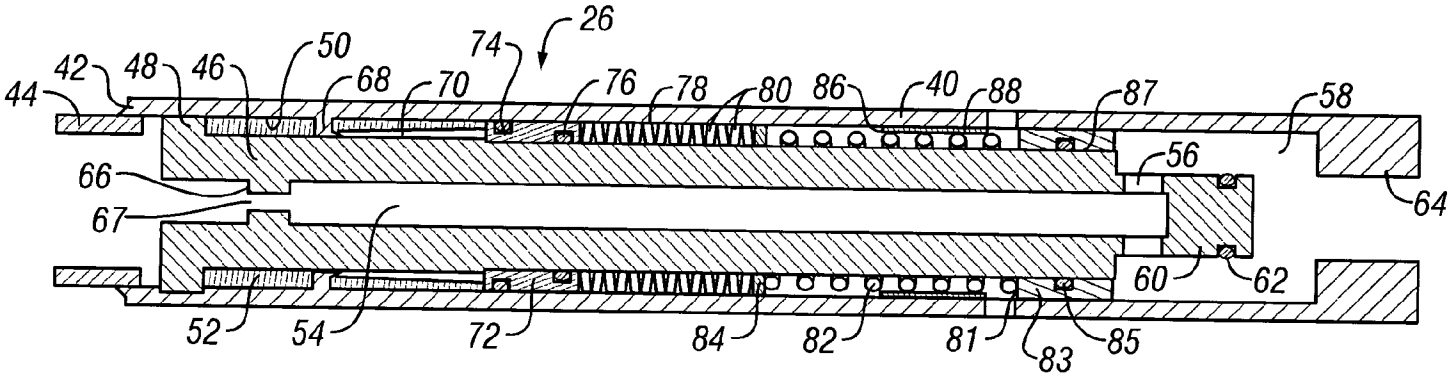
Figure 5:
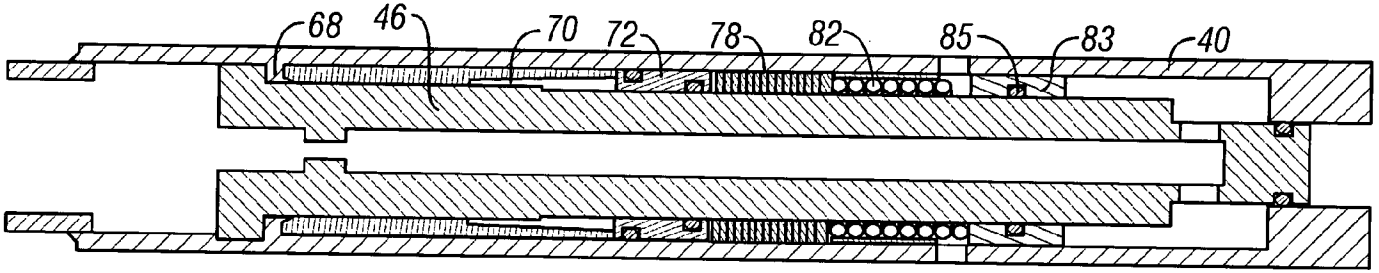
Figure 6:
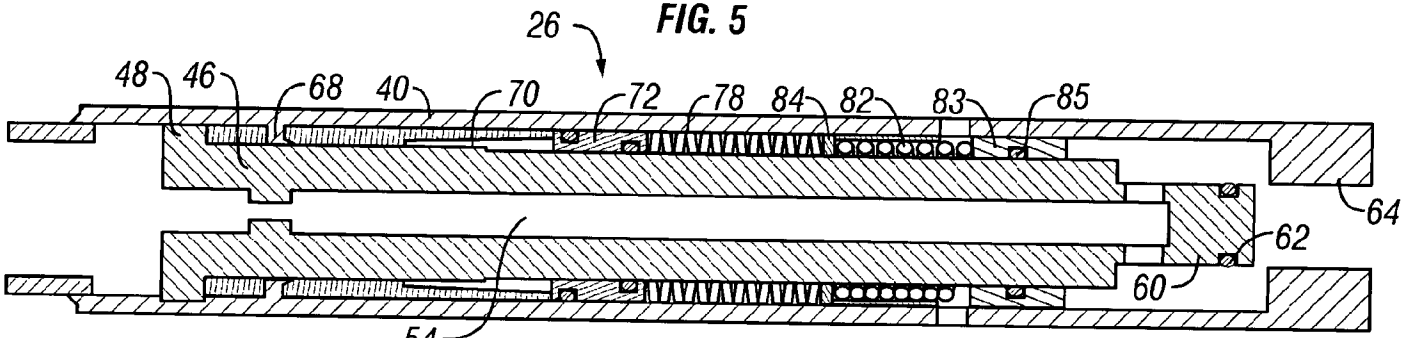

The Position 3 operational sequence of the flow responsive indexing dump valve mechanism is illustrated in the schematic illustration of FIG. 4. Once the tool has cycled to position 2, shown in FIG. 3, fluid flow is decreased. This reduces the flow responsive differential pressure acting on the tubular valve operating mandrel 46 and the power piston 72. As the pressure continues to decrease, the low load coil spring 82 pushes the power piston 72 upward, which pushes the tubular valve operating mandrel 46 upwardly (due to its releasable connection with an interfering ratchet thread of a collet mechanism, as is described in greater detail below in connection with FIGS. 7A-1, 7A-2, 7B-1 and 7B-2 through 11A-1, 11A-2, 11B-1 and 11B-2. When the tubular valve operating mandrel 46 is near the top of its stroke the releasing sleeve 68 disengages the ratcheting collet 70 and thus releases the flow responsive spring opposing force acting on the tubular valve operating mandrel 46. The coil spring 82 then returns the power piston 72 to the top of its stroke (Position 3) as shown in FIG. 4. The interference shoulder 155 between the power piston and the tubular valve operating mandrel 46 insures that the tubular valve operating mandrel is also returned to the top of its stroke by spring force acting on the power piston member.

At this point in its operating cycle, the dump valve tool is ready to close. As fluid is pumped across the orifice 67 (area $A_1$) the generated differential pressure acts across the two differential areas ($A_3-A_1$ and $A_2-A_3$). Only a relatively low flow rate across the orifice is required to create a differential pressure responsive force on the tubular valve operating mandrel 46 sufficient to compress the low load energy storage device 82 (in this case a coil spring). The tubular valve operating mandrel 46 and the power piston 72 will then be moved downward together approximately 4 inches by the resultant force. A J-sleeve component of an indexing mechanism, not shown in FIGS. 2-6, but shown at 120 in FIG. 8B-1, will have rotated on a J-mandrel or indexing sub 119, which allows an indexing lug 114 on the mandrel to pass through an internal lug movement slot 134 in the J-sleeve 120 and causes the dump valve mechanism to close (FIGS. 7A-1, 7A-2, 7B-1 and 7B-2 through 11A-1, 11A-2, 11B-1 and 11B-2) when the annular seal member 262 enters the internal cylindrical seat surface 260. With the dump valve closed and the casing interval being straddled isolated, the fracturing or other well treatment operation can take place and the treatment pressure may be cycled upwardly and downwardly while the dump valve remains closed as long as a minimum differential pressure is maintained. Once the dump valve is closed, flow across the orifice 67 of a flow restrictor 66 is blocked and the differential pressure created by flow across the orifice 67 is eliminated. However, a differential pressure still exists between $P_{inside}$ and $P_{annulus}$. Pressure $P_{inside}$ is now the sum of hydrostatic pressure created by the column of fluid in the coiled tubing plus any applied pressure at the surface from a pump. The dump valve mechanism will remain in the closed position as long as the minimal pressure differential acting on the sum of the differential areas ($A_3$, $A_2-A_3$ and $A_4-A_5$) plus friction is larger than the stored force of the first and second energy storage devices.

Both the ratcheting collet 70 and the power piston 72 (referred to herein as the ratcheting power piston) and the indexing J-slot mechanism 119–120 are assembled in the annular space 52 between the tubular valve operating mandrel 46 and the tool housing along the length of the tubular valve operating mandrel. A light compression spring representing the second energy storage device 82 provides the minimal force that is needed to power or cycle the indexing mechanism. Disc springs (Belleville Washers) having a heavier load capacity, as compared with the light compression spring, are used to provide power for return movement of the ratcheting power piston.

Previous dump valve type slurry removal tools contained a one-spring system that was capable of only two operating positions, either open or closed. The dump valve mechanism of the present invention can be placed in an intermediate position as well. This intermediate position increases the functionality of the tool by preventing accidental closure either due to the free fall of fluid through the coiled tubing or during flushing of the tool. Also, since the tool can remain open in the intermediate position at flow rates above the prescribed closure rate, the flow rate can be increased, which allows for a thorough clean-out of the straddle tool and coiled tubing.

The indexing mechanism can be designed to provide any combination of open/closed cycles. In its simplest form the indexing mechanism has two positions, one open and one closed. A third position could also be employed which could be either an open or closed cycle. Additional positions could be added with either position as an option.

In previous dump valve tools, the opening and closing mechanisms are tied to the same energy source. Hence, if a high load spring is needed to accomplish dump valve opening in wells with small reservoir pressures, the same high load spring must be closed with exceedingly high flow rates. This is inherently dangerous, since closing at high flow rates can generate a large pressure spike that can destroy the sealing elements of the tool as well as damage other tool components. The present dump valve tool employs two different sized springs to accomplish the same result. This difference allows the user to employ a low flow rate to close the tool and still generate a large release force to open the dump valve mechanism against large hydrostatic gradients. This allows efficient operation of the dump valve tool in wells having lower bottomhole pressures.

Figures 1, 7A:
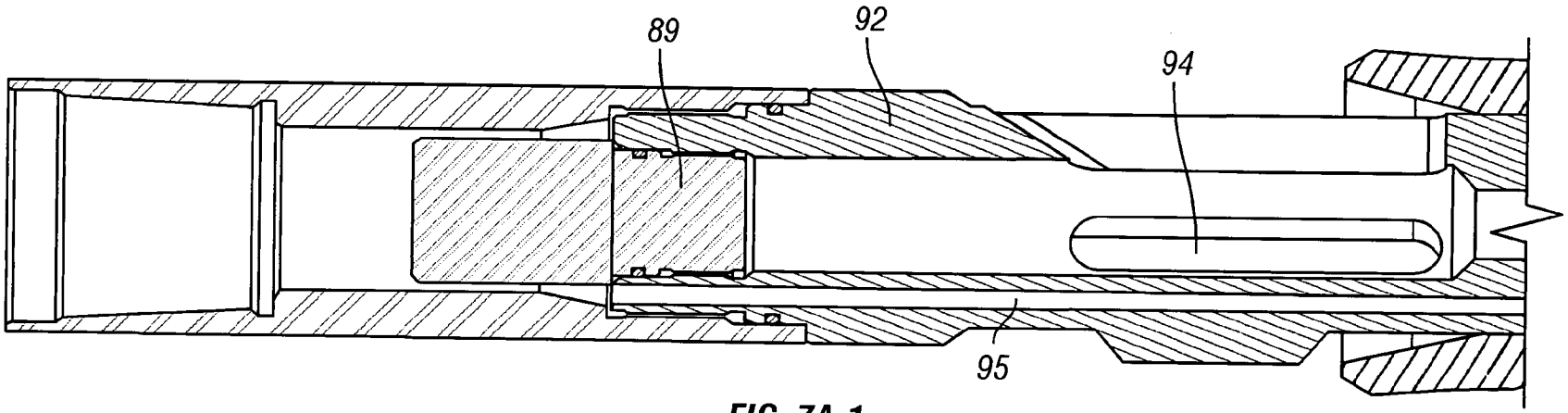
Figures 2, 7A:
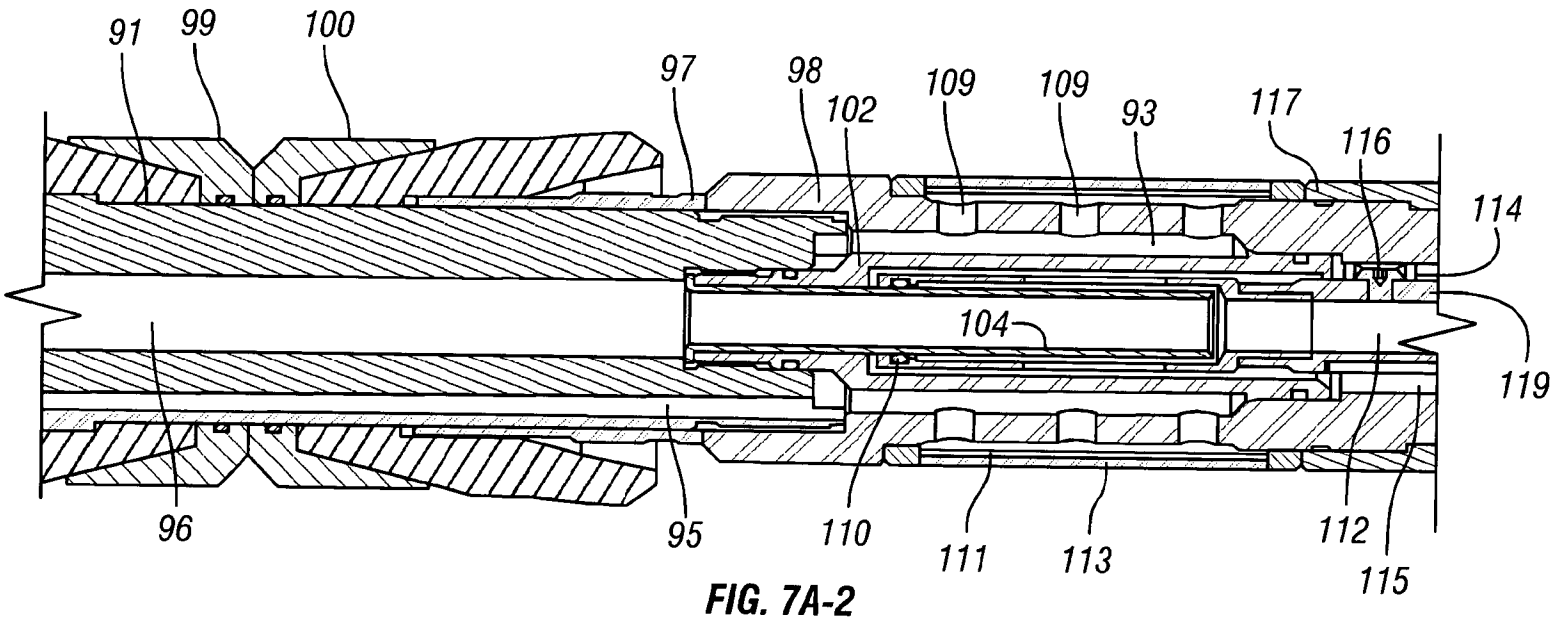
Figures 1, 7B:
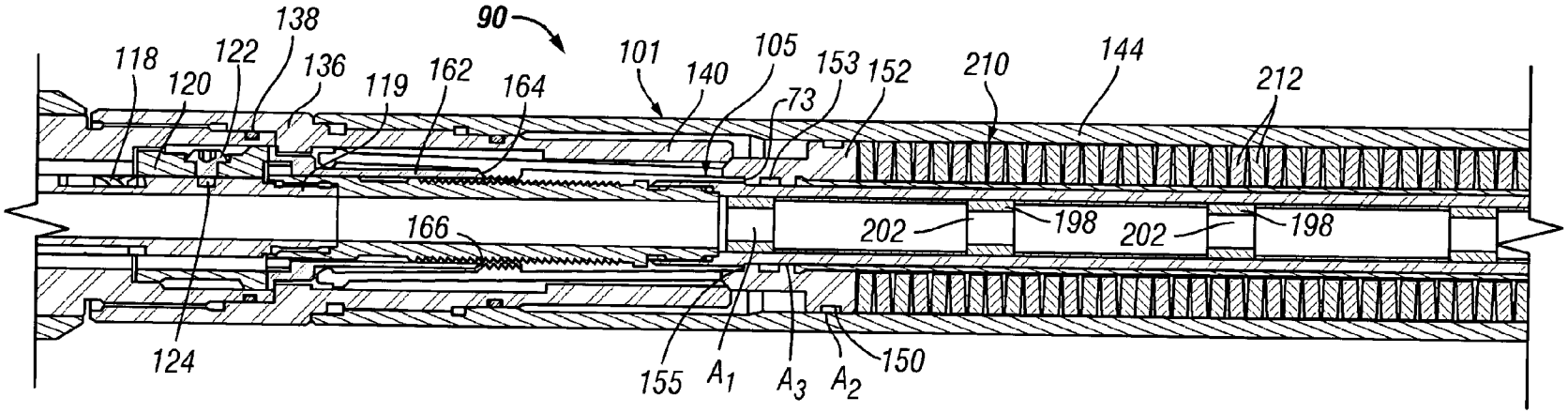
Figures 2, 7B:
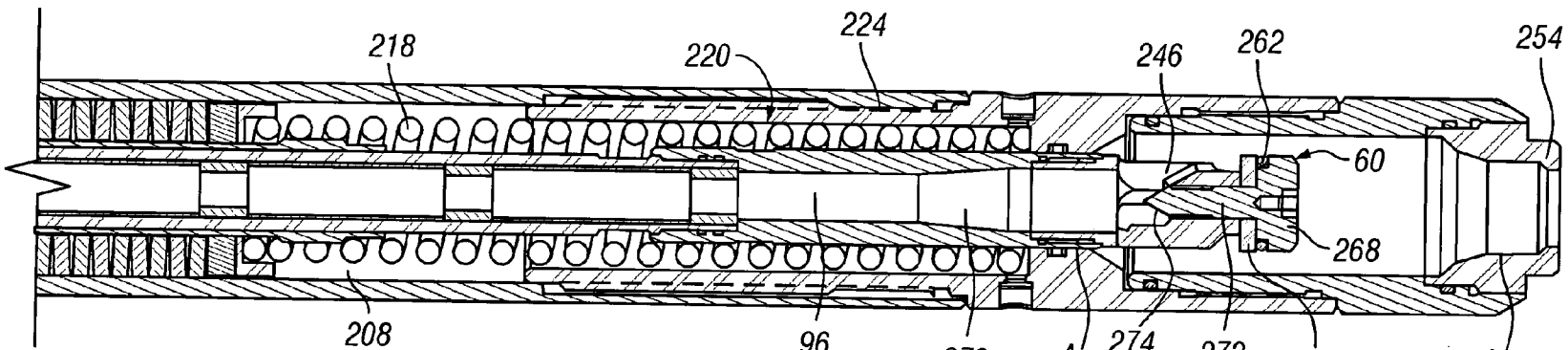

Referring now to FIGS. 7A-1, 7A-2, 7B-1 and 7B-2 through 11A-1, 11A-2, 11B-1 and 11B-2, which are more detailed illustrations of the features shown in FIGS. 2–6, the longitudinal sectional views show the multi-cycle dump valve mechanism of the present invention generally at 90 and illustrate the various operational sequences thereof and further show the dual J-slot indexing mechanism that was not shown in the previous figures for purposes of simplicity. With regard to FIGS. 7A-1, 7A-2, 7B-1 and 7B-2, FIGS. 7A-1, 7A-2 illustrate the upper portion of the dump valve mechanism 90 and FIGS. 7B-1 and 7B-2 show the lower section of the dump valve mechanism. An "in" sub is shown at 92 in FIG. 7A-1, which is a lower component of a straddle packer well treatment tool and defines a plurality of "in" ports 94 through which well treatment fluid is communicated from a packer isolated perforated casing interval to a flow passage 96 of the "in" sub, thus permitting fluid, typically a slurry that is present in the tubing string and the straddle packer tool annulus, to be dumped into the well casing below the straddle packer tool by opening the valve of the dump valve mechanism. A plug member 89 blocks the central flow passage of the "in" sub above the "in" ports 94 and thus restricts the flow of fluid entering the tool from the interval annulus to discharge via the dump valve mechanism. The lower portion of the "in" sub 92, as shown in FIG. 7A-2 defines a packer support surface 91 which provides support for oppositely facing cup packer assemblies 99 and 100 that prevent upward or downward flow in the casing annulus at the lower end of the straddle packer tool. The packer elements are secured by a retainer member 97 that is positioned by a screen housing sub 98 that is threaded to the "in" sub of the straddle packer tool and also functions as a component of the indexing mechanism of the dump valve. A dump valve housing, shown generally at 101 in FIG. 7B-1, extends downwardly from the screen housing sub 98 and provides a protective, pressure containing or isolating enclosure for the dump valve and the flow responsive dump valve control mechanism and incorporates a number of interconnected housing subs which are discussed in detail below. A tubular connector member 102 is threadedly connected and sealed to the "in" sub 92 and is sealed within the lower packer housing 98 and retains a tubular member 104 in substantially centralized spaced relation with the tubular connector member 102. The lower packer housing 98 is of tubular configuration and defines an internal chamber 115. An elongate tubular valve operating mandrel, shown generally at 105, incorporates a number of interconnected tubular subs or components and is linearly moveable within a valve housing responsive to flow to achieve selective positions for dump valve operation. A slotted sleeve member 106 of the tubular valve operating mandrel 105 has a plurality of fluid communication slots 108, communicating fluid from the tubular member 104 to the internal chamber 115 and is interposed between the tubular connector member 102 and the tubular member 104. The slots 108 have a width smaller than the typical dimension of a grain of sand and serve a screening function to exclude all but very fine particulate from the fluid passing through the slots and entering the chamber 115. The slotted sleeve member 106 is provided with a telescoping end that is disposed in telescoping relation with the tubular member 104 and has an annular debris scraper or wiper member 110 that maintains scraping or wiping engagement with the tubular member 104 during linear movement of the slotted sleeve member 106 by the tubular valve operating mandrel 105. The slotted sleeve member 106 is threadedly connected with a tubular indexing sub 119 that is also a component of the tubular valve operating mandrel 105. The screen housing sub 98 defines multiple ports 109 that are surrounded by a debris screen 113 through which bypass fluid flows from the annulus below the straddle packer tool as the fluid is displaced during positioning movement of the tool within the well casing. The fluid from the debris screen enters an annulus 111 and is conducted via the ports 109 to an annulus 93 of the screen assembly. The annulus 93 is in communication with a bypass passage 95 for bypassing annulus fluid from below the straddle packer, through the debris screen element 113, then through the annulus 93 and bypass passage 95 and the passage-ways in the straddle packer to the annulus above the straddle-packer. A tubular retainer element 117 is threaded to the screen housing sub 98 and serves to retain the lower debris screen element 113 in assembly with the screen housing sub. The screen housing sub 98 and a collet control housing sub 136 cooperatively define the internal chamber 115.

As shown in FIGS. 7A-2 and 7B-1, the tubular indexing sub 119 is moveable within the internal chamber 115 and is provided with an indexing lug 114 that is mounted to the tubular indexing sub 119 by means of a mounting bolt 116. As the tubular indexing sub 119 is moved linearly the indexing lug 114 is moved within the annular chamber 115 and contacts other structure to define the limits of upward and downward movement of the tubular valve operating mandrel 105 and thus the valve element that is connected to it. Simultaneously, the slotted sleeve member 106 is moved linearly in telescoping relation with the tubular member 104 and the annular wiper or scraper member 110 maintains its wiping relationship with the outer cylindrical surface of the tubular member as is shown in the various figures.

The screen housing sub 98 defines an annular indexing receptacle 160 within which an indexing sleeve 120 is rotatably received and within which the indexing sleeve 120 is restrained against all but minimal linear movement. The tubular indexing sub 119 defines an indexing slot 118 in the form of a J-slot and the indexing sleeve 120 is positioned within the annular indexing receptacle 160 for rotational movement relative to the tubular indexing sub in the region of the J-slot (See also FIGS. 12A, 12B, 12C and 13). The annular indexing receptacle 160 is defined in part by an annular restraining shoulder 158 which prevents upward linear movement of the indexing sleeve 120 and allows its rotary movement. Downward linear movement of the indexing sleeve 120 is prevented by an annular positioning flange 156 of an annular member 154 as will be explained in greater detail below. A slot tracking bolt 122 is threaded into the tubular indexing sleeve 120 and includes a slot tracking element 124 that projects into the indexing J-slot 118 of the tubular indexing sub 119 and by following the J-slot, controls the rotational position of the indexing sleeve 120 relative to the indexing sub 119 at all of the operational positions of the dump valve mechanism. The indexing sleeve 120 defines external flanges 126 and 128 that are slotted as shown at 130 and 132, as is evident from FIGS. 12A, 12B, 12C and 13, to permit fluid pressure transmission via a flow path exteriorly of the rotatable indexing sleeve 120 and externally of the tubular valve operating mandrel 105.

Figures 1, 9A:
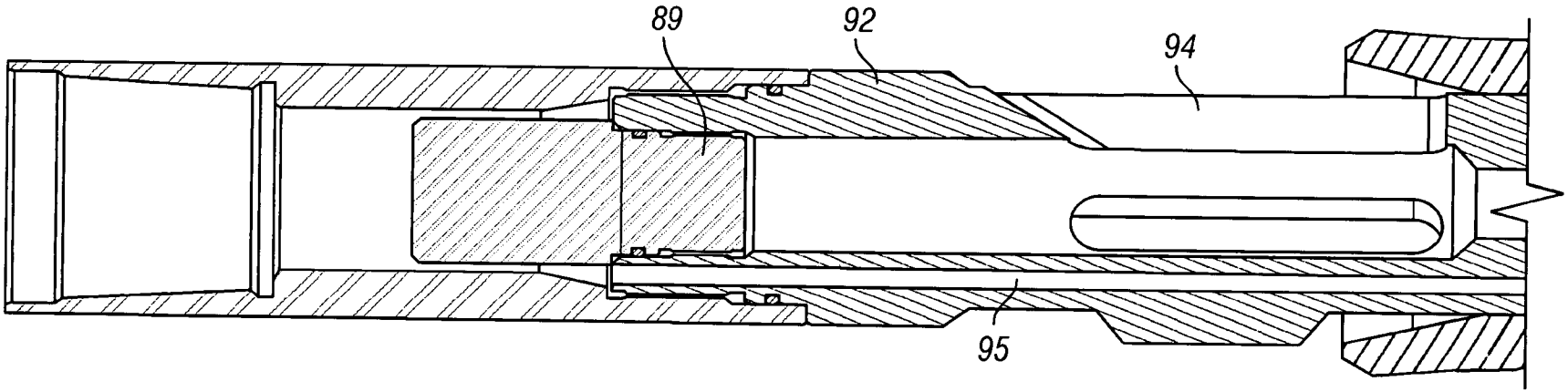
Figures 2, 9A:
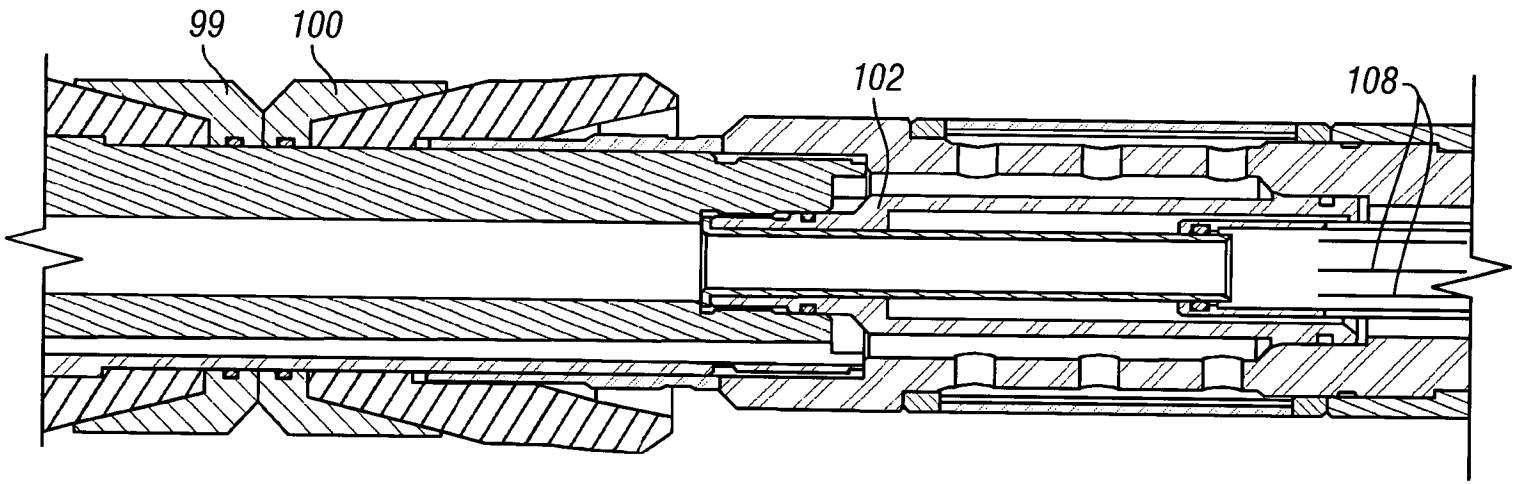
Figures 1, 9B:
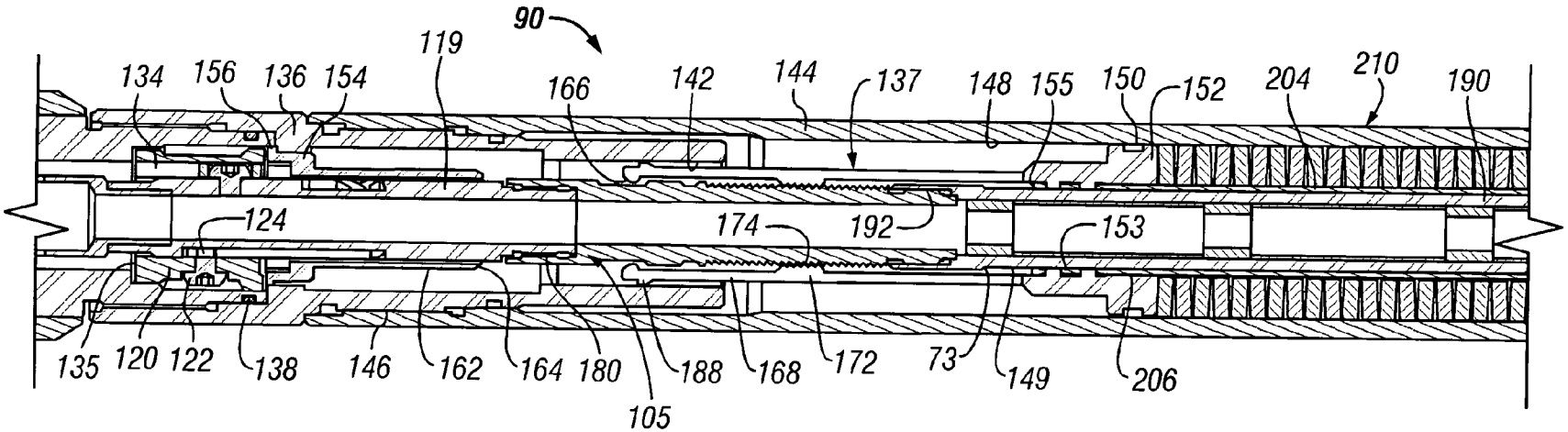
Figures 2, 9B:
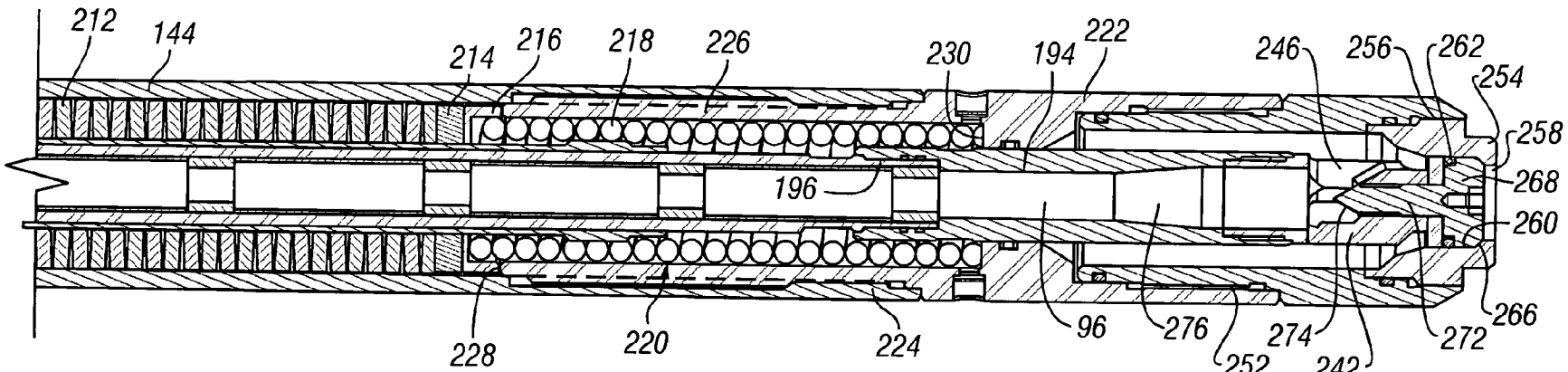

The indexing sleeve 120 also defines an internal lug movement slot 134 of a dimension for receiving the indexing lug 114 as is evident from FIG. 9B-1, assuming the indexing sleeve 120 is rotationally positioned so as to orient the internal lug movement slot in aligned relation with the indexing lug 114 and thus permit downward movement of the indexing lug 114 through the internal lug movement slot 134 and permit downward movement of the tubular indexing sub 119 along with other interconnected components of the tubular valve operating mandrel 105 to its valve closed position. The upper end of the indexing sleeve 120 defines an annular stop shoulder 135 that is engaged by the indexing lug 114 when the internal lug movement slot 134 is not rotationally oriented to receive the indexing lug, thus providing a stop to limit downward movement of the indexing lug, the tubular indexing sub 119 and thus the tubular valve operating mandrel 105. This feature prevents flow responsive closure of the dump valve mechanism even under circumstances where the differential pressure acting on the flow responsive valve actuating mechanism is otherwise sufficient to achieve flow responsive valve closure. This feature also prevents the dump valve from inadvertent closure by the velocity and head pressure of fluid being dumped from the tubing string and casing annulus, especially when a large volume of well treatment fluid and flushing fluid is being dumped.

To the lower packer housing 98 is threaded a tubular collet control housing sub 136 that is sealed to the lower packer housing 98 by an annular seal member 138 and contains a ratcheting collet mechanism shown generally at 137. The tubular collet control housing sub 136 defines a tubular collet control projection 140 having an internal collet control surface 142. A piston and spring housing sub 144 of the dump valve housing 101 is threaded to the tubular collet control housing sub 136 by thread connection 146 and defines an internal cylindrical piston surface 148 with which sealing engagement is established by the annular piston seal 150 of a power piston member 152. The power piston member 152 is provided with an inner piston seal 153 that maintains sealing of the power piston member with an external cylindrical seal surface 149 of a tubular member, thus defining the pressure responsive area $A_3$. Contact of the annular piston seal 150 with the internal cylindrical piston surface 148 defines the pressure responsive area $A_2$ which is identified in FIG. 2 and discussed above. An internal piston seal member 153 of the power piston member 152 defines the pressure responsive area $A_3$ that is identified in FIG. 2.

Internally of the tubular collet control housing sub 136, there is threaded an annular member 154 having an annular positioning flange 156 that is engaged by the lower end of the indexing sleeve 120 to confine the indexing sleeve to rotational movement and to limit downward linear movement thereof. The annular positioning flange 156 cooperates with an opposing annular internal shoulder 158 of the lower packer housing 98 to define an annular chamber 160 within which the indexing sleeve 120 is rotatable as its slot tracking element 124 moves within the indexing J-slot 118.

As shown in FIG. 9B-1, a collet release sleeve 162 projects downwardly from the annular member 154 and defines a tapered collet release end 164 that is positioned for releasing contact with correspondingly tapered shoulders 166 of a plurality of elongate flexible collet fingers 168 that are integral with an annular extension 170 of the power piston 152. Each of the elongate collet fingers defines an intermediate collet retainer section 172 that defines internal buttress type thread sections 174 that are disposed for latching engagement with external buttress type threads 176 of a tubular ratcheting collet member 178. The tubular ratcheting collet member 178 is connected with the tubular indexing sub 119 by a threaded connection 180. The upper ends of each of the elongate flexible collet fingers 168 each define a projection 182 for controlling ratchet disengagement with the collet release sleeve 162. The upper ends of each of the elongate flexible collet fingers 168 also define external collet control projections 188 that are disposed for controlling engagement with the internal collet control surface 142 at Positions 2 and 4 of the dump valve mechanism to prevent release of the collet fingers from the buttress threads of the ratcheting collet member 178.

An elongate tubular member 190 is connected at its upper end to the ratcheting collet member 178 by a threaded connection 192 and is connected at its lower end to a tubular valve positioning sub 194 by a threaded connection 196. At least one and preferably a plurality of flow restricting members 198 are located within the elongate tubular member 190 and are maintained in spaced relation by tubular spacer members 200. The flow restricting members 198 each define orifices 202 through which fluid must flow and across which differential pressure is developed during the flow of fluid. Thus, responsive to flow through the orifices, a downward flow responsive force acts on the elongate tubular member 190 and the power piston 152 and moves them downwardly permitting movement of the dump valve mechanism from Position 1 of FIGS. 7A-1, 7A-2, 7B-1 and 7B-2 toward Position 2 of FIGS. 8A-1, 8A-2, 8B-1 and 8B-2. The indexing lug 114 contacts the indexing sleeve 120 prohibiting further movement of the tubular valve operating mandrel 105. Maintaining flow through the orifices will cause ratcheting of the buttress threads past one another as the power piston continues to move downward relative to the valve operating mandrel 105 to Position 2. At Position 2, the external collet control projections 188 will have moved into engagement with the internal collet control surface 142, thereby restraining radially outward movement of the ends of the elongate flexible collet fingers 168. It should be borne in mind that even with the ends of the elongate flexible collet fingers 168 restrained in this manner, the flexibility of the collet fingers and the location of the buttress thread sections intermediate the length of the collet fingers will permit relative ratcheting movement of the buttress threads of the collet fingers and the tubular ratcheting collet member 172. It should also be borne in mind that the unidirectional ratcheting of the buttress threads will allow the tubular ratcheting collet member 172 to move downwardly relative to the tubular valve operating mandrel 105 but will prevent relative movement in the opposite direction unless buttress thread engagement is forcibly released.

As is evident from FIG. 9B-1, a tubular spring guide sleeve 204 is positioned about the elongate tubular member 190 and is connected within the lower end of the power piston 152 by a threaded connection 206 and is thus disposed in spaced relation with the inner surface of the piston and spring housing 144 and thus defines an annular spring chamber 208. A first high load energy storage device shown generally at 210, consisting of a plurality of high load disk spring elements 212 is located within the spring chamber 208 and is disposed in force transmitting relation with the lower end of the power piston 152. The lower end of the stack of high load disk spring elements 212 is disposed in force transmitting engagement with an annular spacer or spring follower element 214. A spring positioning member 216 is disposed in engagement with the annular spacer or spring follower element 214 and provides for positioning of the upper end of a coil spring 218 which represents a second low energy storage device generally shown at 220. As mentioned above, the high and low load energy storage devices 210 and 220, though shown as springs herein, may take any one of a number of different forms that are identified herein.

Figures 1, 8A:
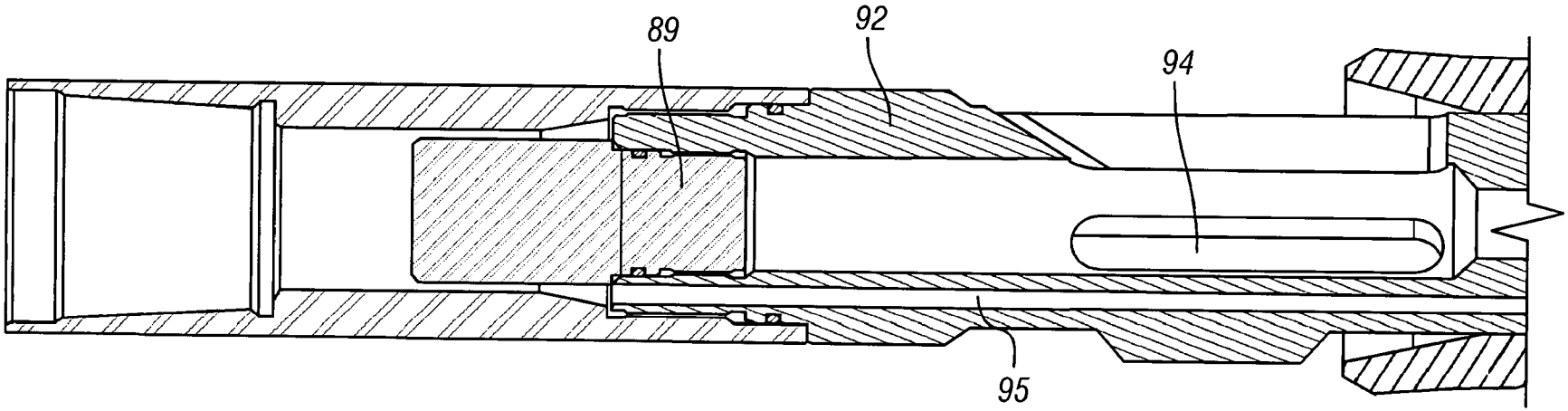
Figures 2, 8A:
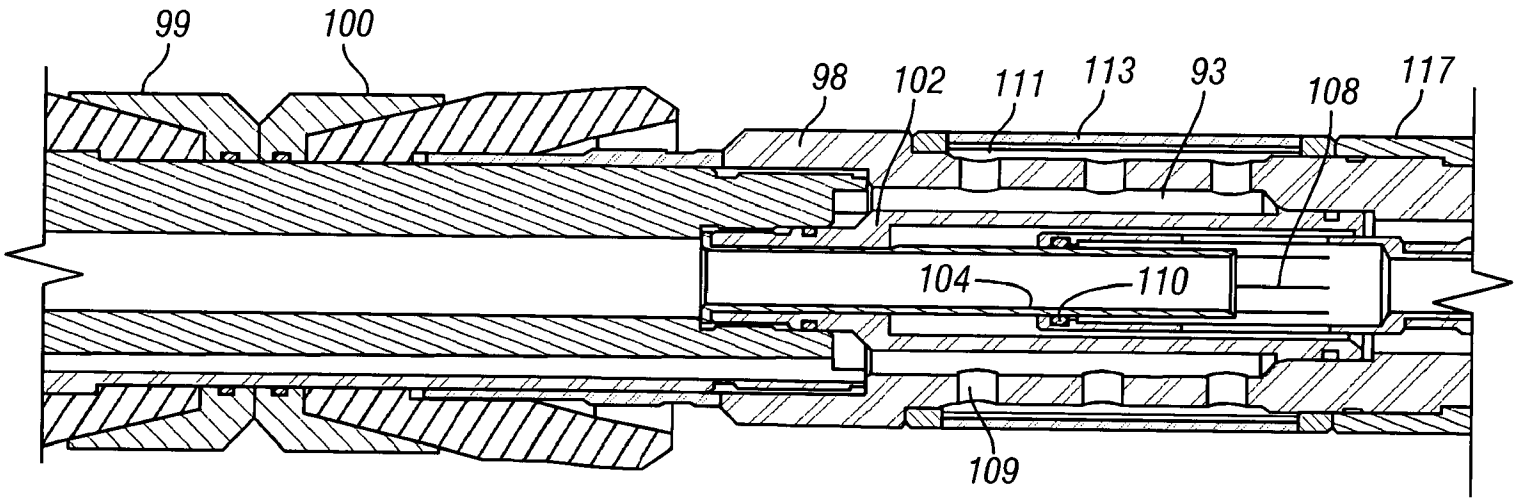
Figures 1, 8B:
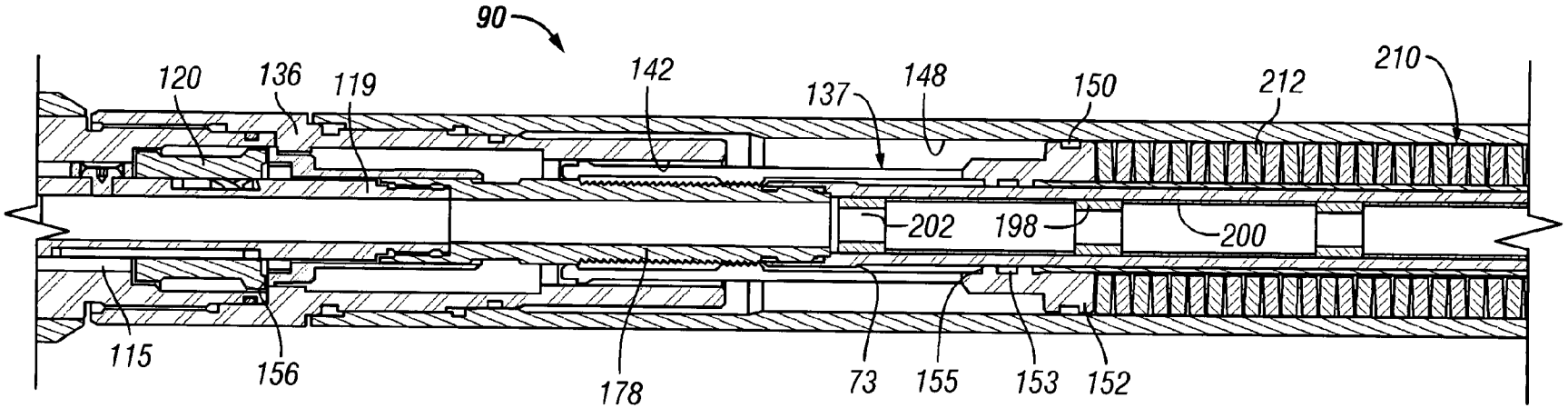
Figures 2, 8B:
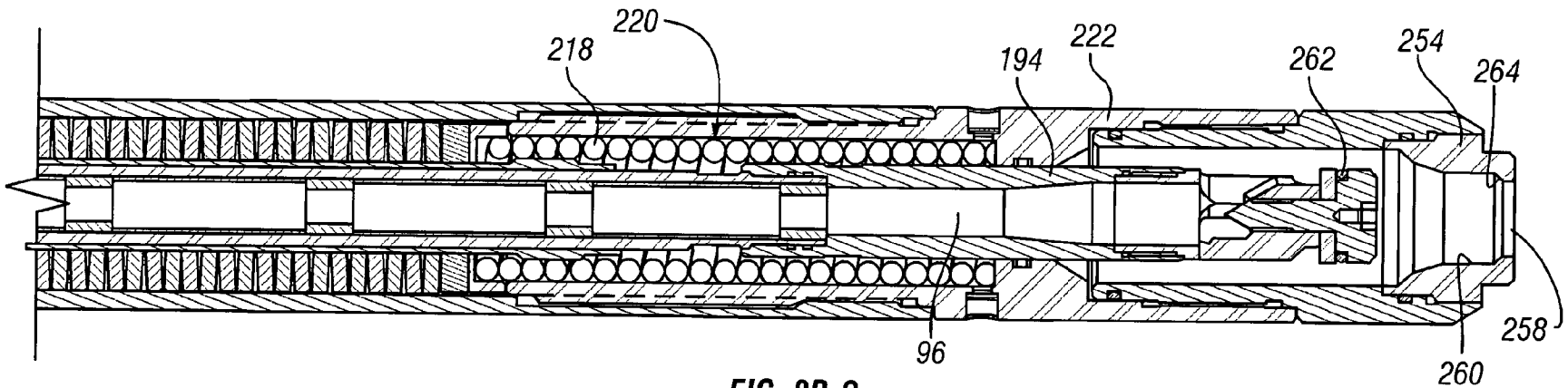
Figures 1, 10A:
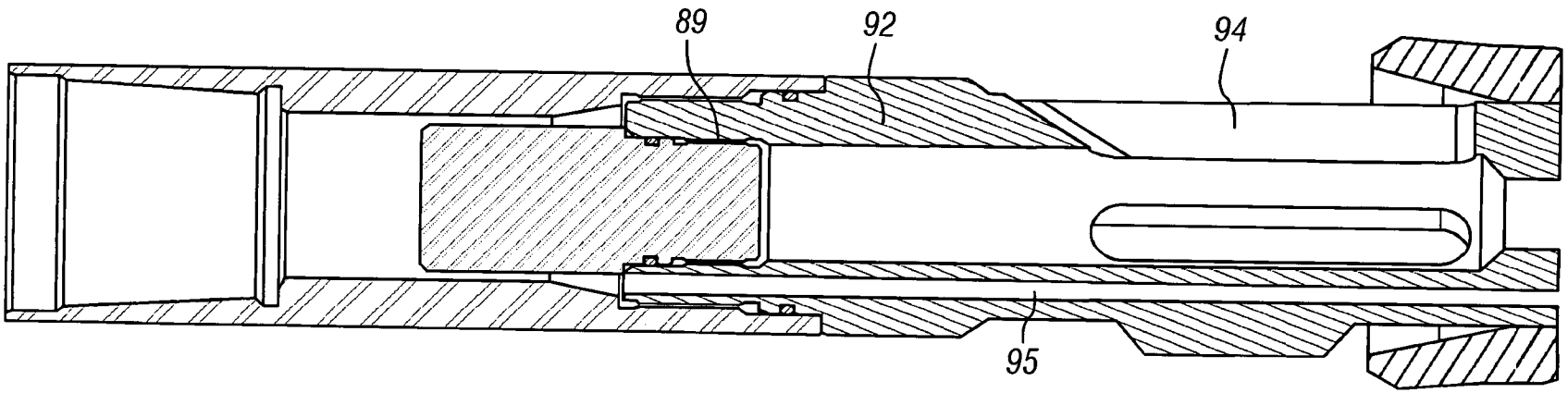
Figures 2, 10A:
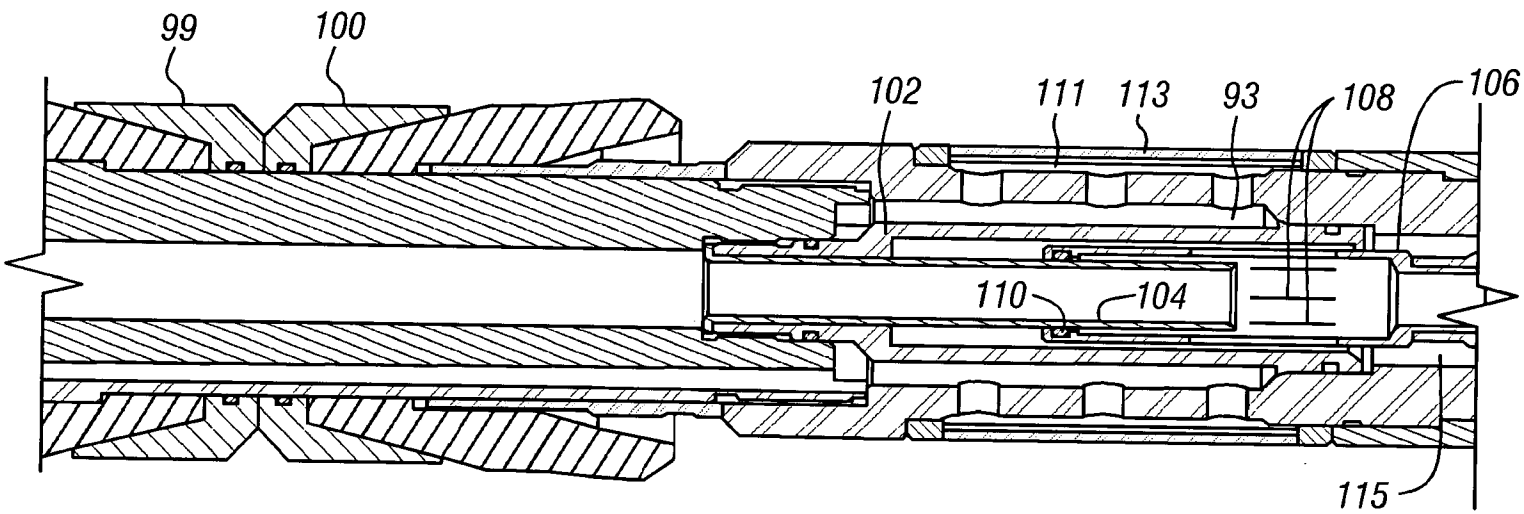
Figures 1, 10B:
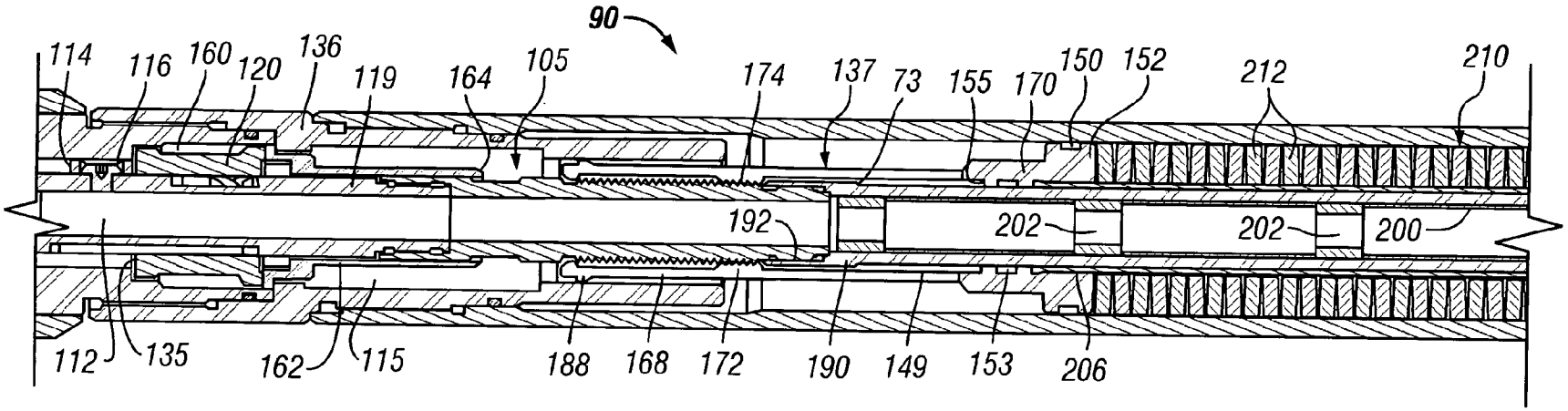
Figures 2, 10B:
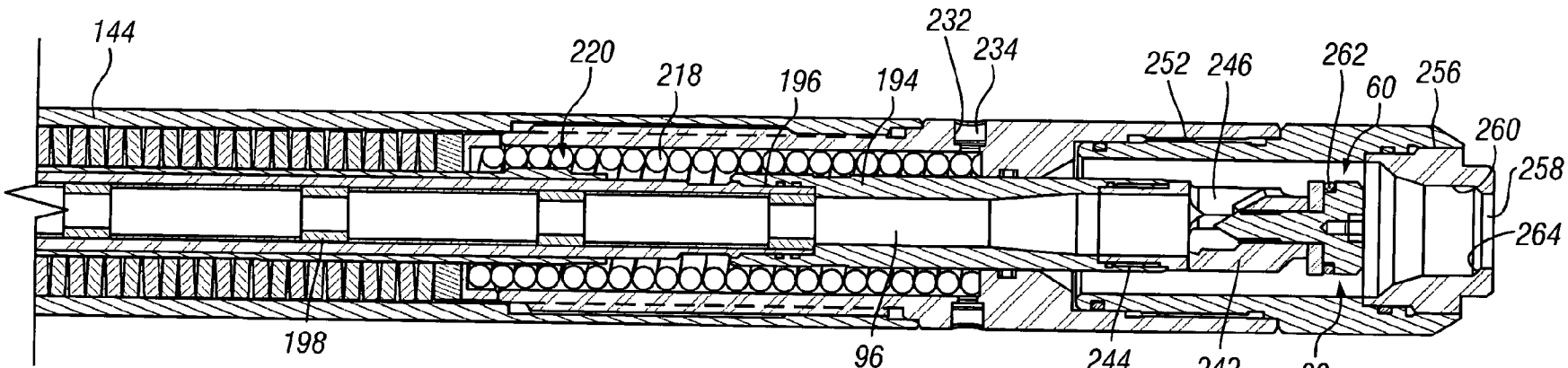

It is desirable to limit compression of the low load coil spring 218 to minimize the potential for damage to the spring or the other components of the dump valve mechanism. To accomplish this feature and to retain both the high and low load springs within the annular spring chamber 208, a spring retainer housing sub 222 is threaded to the piston and spring housing 144 by a thread connection 224. The spring retainer housing sub 222 defines a tubular spring stop extension 226 defining an annular end shoulder 228 that is disposed for stopping engagement by the spring positioning member 216, as shown in FIGS. 8B, 9B and 10B, when the low load coil spring 218 has been compressed to its maximum allowable extent. The lower end of the coil spring 218 is disposed in retained and positioned engagement with an annular spring seat surface 230 which defines the lower end of the annular spring chamber 208. Ports 232 communicate the annular spring chamber 208 with the well casing and permit fluid interchange to accommodate fluid displacement that occurs during movement of the internal components of the dump valve mechanism. Filters 234 may be provided in the ports to exclude the particulate matter of the fluid within the casing.

The valve positioning sub 194 is connected with the lower end portion of the elongate tubular member 190 by a thread connection 196 and is sealed with respect to the spring retainer housing sub 222 by an annular seal 240. A valve member, shown generally at 60, and being shown schematically in FIGS. 2–6, incorporates a valve body sub 242 that is connected with the valve positioning sub 194 by the thread connection 244 as mentioned above. The valve body sub 242 defines an outlet port 246 that is in fluid communication with the flow passage 96 of the straddle packer tool and the flow responsive dump valve tool. The outlet port 246 opens laterally and downwardly to accomplish smooth lateral transition of the flowing fluid, typically abrasive particulate laden slurry from the flow passage 96 into the valve chamber 248 in a manner that causes minimal erosion of the valve components. The fluid from the outlet port 246 is directed laterally into a valve chamber 248 that is defined by a seat support housing sub 250 that is connected with the spring retainer housing sub 222 by a thread connection 252. A replaceable valve seat member 254 is connected with the spring retainer housing sub 222 by a thread connection 256 and defines a discharge port 258 from which dumped fluid flows into the well casing below the straddle tool and dump valve mechanism. The valve seat member 254 defines an internal cylindrical seat surface 260 which is engaged by an annular seal member 262 of the valve member 60. The valve seat member 254 also defines an internal tapered annular seat surface 264 which is engaged by a correspondingly tapered annular surface 266 of a seal retainer member 268. As shown in FIG. 7B-2, the seal retainer member 268 and a seal retainer washer 270 cooperate to define an annular seal recess within which the annular seal member 262 is retained. The seal retainer member 268 includes a threaded projection 272 which is threaded within a central passage of the valve body sub 242 and defines a tapered end 274 that assists the laterally opening geometry of the outlet port 246 in achieving gently altered direction of the fluid flow from the flow passage 96 into the valve chamber 246. This gentle flow transition is also assisted by enlargement of the flow passage 96 at 276, which diminishes the velocity of the flowing fluid just upstream of the outlet port 246.

Referring now to FIGS. 18A and 18B, an alternative embodiment of the present invention is shown, wherein the dump valve mechanism is provided with an over-pressure relief system for opening the valve in the event of excessive pressure. The dump valve mechanism is essentially of the construction and function that is shown and described in connection with FIGS. 7A and 7B through 11A and 11B. In accordance with the alternative embodiment, a valve seat member 278 of the dump valve mechanism is retained within a seat support housing sub 280 by one or more shear members 282 that are threaded into the seat support housing sub 280 and have shear pin elements 284 that extend into shear pin receptacles 286 of the valve seat member. With the valve mechanism in its closed position as shown in FIG. 18A, with the valve member fully seated within the annular seat surface 260 and sealed by the annular sealing member 262, pressure within the valve chamber 248 acts on the valve and seat area that is defined by an annular seal member 288. When the pressure within the valve chamber exceeds a predetermined pressure limit, the shear pins 284 will become sheared and will release the seat member 278 for pressure responsive movement to the position shown in FIG. 18B. At this released position the internal seat surfaces of the seat member 278 will have moved away from sealing engagement with the sealing components of the valve member 268, thereby opening the dump valve mechanism and releasing the pressurized fluid for discharge into the well casing. Though the shear pin ends will fall into the well casing when over-pressure relief occurs, which is ordinarily not a problem, the seat member 278 will be retained in assembly with the seat support housing sub 280 by an internal retainer shoulder 290 of the seat support housing sub 280, which is position for retaining engagement with an annular shoulder 292.

Operation

The dump valve tool is connected with a straddle packer tool and is run into the well casing on a string of coiled tubing or jointed tubing to the zone to be treated. Flush fluid is then pumped through the tool at a sufficient rate generating a required pressure drop across an orifice ($A_1$), series of orifices as shown at 202, or through the restriction defined by the inner diameter of the flow passage 112 of the valve operating mandrel tool itself The pressure drop across the orifice creates a differential pressure ($P_{inside}-P_{annulus}$) which acts across the differential area ($A_3-A_1$) defined by the orifice 202 and the inner seal 153 of the power piston 152 and the differential area ($A_2-A_3$) defined by the seals 150 and 153 of the power piston. The differential pressure applied to the differential area ($A_3-A_1$) generates a force that moves the valve operating mandrel 105 downward and also transfers the force (through an interference shoulder 155) to the power piston 152. The differential pressure also acts on the pressure responsive area ($A_2-A_3$) of the power piston 152 and generates a resultant force which is transferred to the high load energy storage device 210, which in this case is defined by the high load disc springs 212. The disc springs 212 transfer the flow responsive load of the tubular valve operating mandrel 105 and the power piston 152 to the lower load energy storage device 220 which is shown to comprise a lighter coil-type compression spring 218. The mandrel 105 and the power piston 152 travel downward, compressing the coil spring 218, for approximately two inches at which time an indexing lug 114 on the tubular valve operating mandrel 105 moves into contact with an annular stop shoulder 135 of the indexing J-sleeve 120 as shown in FIG. 7B-1, preventing further downward travel of the mandrel. At this point it should be noted that the tubular valve actuating mandrel 105 is at an intermediate position, as is evident from FIG. 8B-2, where its valve member 60 is open and the valve member is prevented from closing due to the position of the indexing sleeve 120. As pressure increases, the tubular valve actuating mandrel is prevented from moving downwardly to a position closing the valve. Additional pressure acting on the power piston 152 continues to compress the coil spring 218 approximately an additional 2 inches until the spring positioning member 216 comes into contact with a spring stop 228 of a tubular spring stop extension 226 (FIG. 8B). The disc springs 212 may be slightly compressed during this operation, but significant differential pressure (resulting in deflection force) cannot be generated with the valve member 60 held in the open position. With the valve maintained open, regardless of the flow rate, efficient clean-out of well treatment slurry can be accomplished.

After approximately the first 2 inches of power piston travel relative to the tool housing a ratcheting collet mechanism shown generally at 137 is activated. The ratcheting mechanism (FIGS. 7A-1 through 11A-2, and FIGS. 15–17) is part of the power piston 152 and uses a modified buttress thread such that when the power piston 152 moves downward relative to the tubular valve actuating mandrel, the 30 degree sides of the buttress threads of the elongate flexible collet fingers and the tubular ratcheting collet 178, ratchet over each other. When the power piston moves upward, relative to the tubular valve operating mandrel 105, the near vertical sides of the buttress threads interfere and prevent relative motion of the power piston and the tubular valve operating mandrel.

A release sleeve 162 is located in the tool housing (FIG. 7B-1) such that when the tubular valve operating mandrel 105 is near the top of it's stroke the tapered release end 164 of the release sleeve slides under the flexible spring fingers 168 of the ratcheting collet disengaging the buttress threads of the flexible spring fingers from the buttress threads 176 of the tubular ratcheting collet member 178. This allows the power piston 152 to be moved upward relative to the mandrel 105 by the return force of the coil spring energy storage device 218 (FIG. 7B-2), thus returning the power piston to it's starting position. An additional feature of the ratcheting collet mechanism 137 is that during the first 2 inches of stroke the collet fingers function as a cantilever style collet, making it easy for the release sleeve 162 to disengage the buttress thread teeth of the ratcheting mechanism (FIG. 7B-1). After approximately 2 inches of additional downward stroke of the power piston 152 the upper ends of the collet fingers 168 enter a reduced diameter bore defining a cylindrical collet control surface 142 within the tubular collet control projection 140 of the tool housing. The cylindrical collet control surface 142 prevents outward motion of the ends of the flexible collet fingers, (FIG. 8B-1). The collet fingers, being restrained by the cylindrical collet control surface 142, now functions as a bow spring style collet which requires greater force to accomplish ratcheting of the buttress threads and hence keeps the threads engaged more securely when the power piston 152 is being moved upward, forcing the mandrel 105 to move upwardly, thus moving the dump valve 60 toward its open condition. Although a particular ratcheting cantilever/bowspring collet design has been incorporated herein and represents the preferred embodiment, it is to be borne in mind that other collet mechanisms and other releasable connector mechanisms may be employed within the spirit and scope of the present invention.

Once the multi-cycle dump valve tool has cycled to Position 2 (FIGS. 8B-1 and 8B-2) flow through the dump valve tool is decreased. This reduces the created differential pressure acting on the valve operating mandrel 105 and the power piston 152. As the pressure continues to decrease the small coil spring 218 of the low load energy storage device 220 pushes the power piston 152 upward, which pushes the mandrel 105 upwardly (due to the interfering ratchet thread). When the mandrel 105 is near the top of its stroke, the releasing sleeve 162 disengages the buttress threads of the spring fingers and the buttress threads of the tubular collet member 178. With the collet connection released, the coil spring 218 then returns the power piston 152 to the top of the stroke, Position 3 (FIG. 7B-1). The interference shoulder 155 between the power piston 152 and the mandrel 105 insures that the mandrel is also returned to the top of the stroke.

It is important to note that during spring energized movement of the dump valve to Position 3, as shown in FIG. 7B-1, the J-slot geometry 118 of the indexing sub 119 causes the indexing sleeve 120 to rotate to the valve closing position, orienting the internal lug movement slot 134 in registry or alignment with the indexing lug 114. With the indexing sleeve in this position, subsequent downward force on the mandrel 105, which is accomplished by flow across the orifice 202, permits movement of the indexing lug through the internal lug movement slot 134, thus causing the valve element 60 to be moved to its closed position with respect to the valve seat.

The dump valve tool is now ready to close. As fluid is pumped across the orifice 220 ($A_1$) the generated differential pressure acts across the two differential areas ($A_3$–$A_1$and $A_2$–$A_3$). A relatively low flow rate is required to create a force sufficient to compress the coil spring of the small energy storage device 220. The mandrel 105 and the power piston 152 move downward together for approximately 4 inches. The J-sleeve type indexing member 120, during such movement will have rotated on the indexing sub or J-mandrel 119 which allows the indexing lug 114 on the mandrel 105 to pass through the internal slot 134 of the indexing J-sleeve 120, thus permitting the tubular valve operating mandrel 105 to move downwardly to a position closing the dump valve (FIGS. 9B-1 and 9B-2). With the primary dump valve 60 closed, a fracturing job or any other type of well treatment can take place. Once the dump valve 60 is closed, flow across the orifice 220 is blocked and the differential pressure created by flow across the orifice is eliminated. However, a differential pressure still exists between $P_{inside}$ and $P_{annulus}$. $P_{inside}$ is now the sum of hydrostatic pressure created by the column of fluid in the coiled tubing plus any applied pressure at the surface from a pump. The dump valve mechanism will remain in the closed position as long as the minimal pressure differential acting on the sum of the differential areas ($A_3$, $A_2$–$A_3$ and $A_4$–$A_5$) plus friction is larger than the stored force of the energy storage devices 210 and 220.

When the valve member 60 closes (FIG. 9B-2), pressure $P_{inside}$ now acts on three differential areas. The internal pressure still develops a force acting downwardly on the differential area ($A_2$–$A_3$) of the power piston 152. Since there is no flow when the dump valve 60 is closed, the effective area of the mandrel 105 is now area $A_3$ which is defined by the inner piston seal 153. With the valve closed, pressure $P_{inside}$ is also acting on the differential area $A_4$–$A_5$. If area $A_5$ is larger than area $A_4$ the net force is downward. This condition would help to keep the valve closed at lower pressure differentials. If area $A_5$ is smaller than area $A_4$ the net force is upward. This condition would help to open the valve at lower pressure differentials. If area $A_5$ is equal to area $A_4$ the net force is zero and the valve 60 responds as it did prior to closure.

While the dump valve tool is closed the desired coiled tubing operation may be performed with respect to the formation interval that is exposed via the perforations in the casing annulus between the straddle packers. This may be a fracturing job where proppant suspended in a fluid and forming a slurry is pumped into a fracture at high rates. This causes an increase in pressure inside the straddle tool. As the pressure increases the differential pressure acting on the power piston 152 ($A_2$–$A_3$) increases. This results in increased forces acting on the disc springs 212. As the disc springs 212 deflect, the ratcheting collet moves down the mandrel via the ratcheting collet mechanism 137, storing energy in the disc spring stack. As long as the differential pressure increases the disc springs 212 are compressed further, storing more energy. After the maximum energy of the system has been stored, the disc springs 212 will be in a flat condition and additional pressure will not result in more stored energy.

During some fracturing treatments a high initial pressure is required to initiate the fracture. After the fracture is started the pressure required to extend the fracture is reduced and thus pressure $P_{inside}$ is reduced. In other cases, where a horizontal fracture is created, the pressure decreases throughout the job. In both of these situations it is important that the dump valve 60 remain closed even though the fracturing pressure is reduced. The valve seat 254 is designed so that a predetermined length of seal engagement is achieved. As pressure $P_{inside}$ declines, the energy stored in the power spring 210 overcomes the closing force created by differential pressure times the sum of the areas ($A_3$, $A_2$–$A_3$ and $A_4$–$A_5$) plus friction and the power piston 152 exerts force on the tubular valve operating mandrel 105 through the ratcheting collet mechanism 137 and the mandrel 105 begins to move upwardly. The upward motion of the mandrel 105 moves the dump valve seal 262 upward toward the opening position. As the power piston 152 moves upward, the disc spring stack 212 is extending and the amount of stored energy is decreasing. At some point, the differential pressure times the differential area will equal the reduced force of the disc springs 212 and keep the valve 60 closed or the mandrel 105 will continue to move upward and the valve will open and the differential pressure will be equalized. By controlling the spring rate of the power piston 152, the length of dump valve seal engagement and the piston areas of the tool, the tool can be configured to accommodate these reductions in pressure during the well treatment.

Figures 1, 11A:
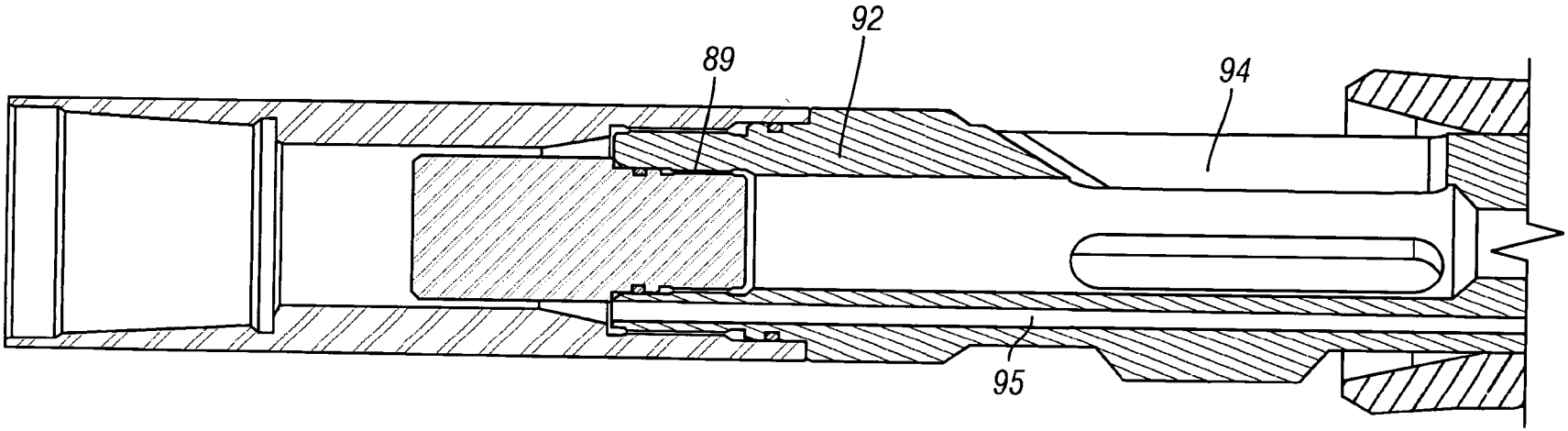
Figures 2, 11A:
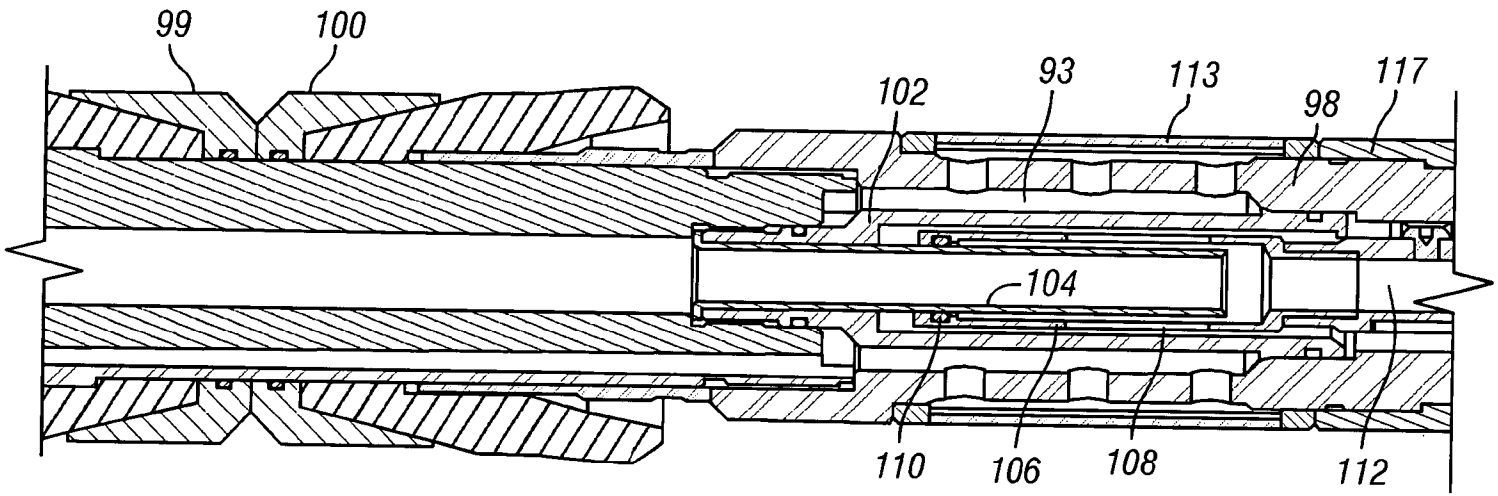
Figures 1, 11B:
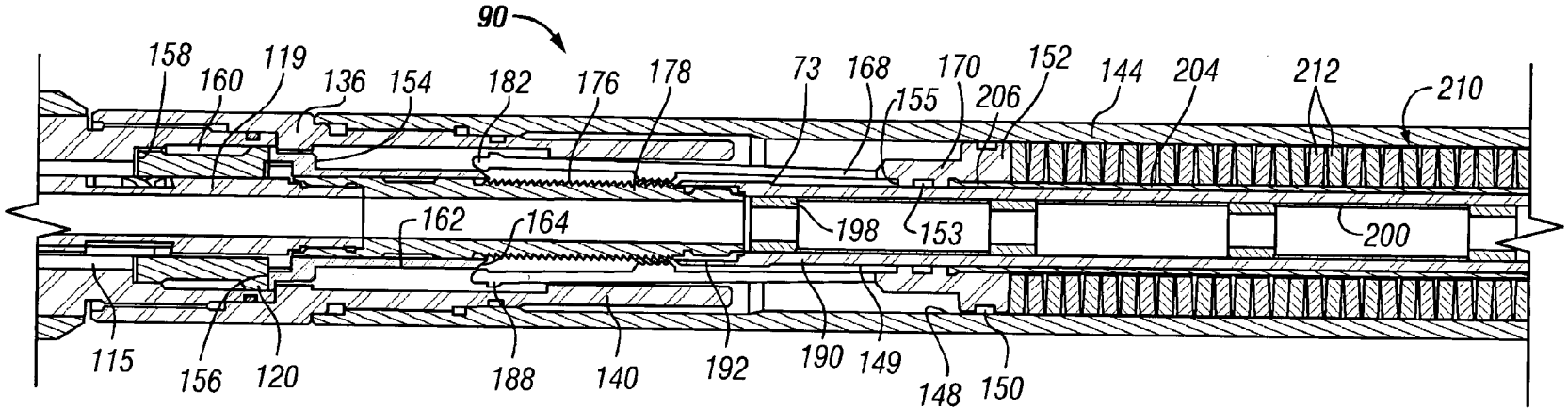
Figures 2, 11B:
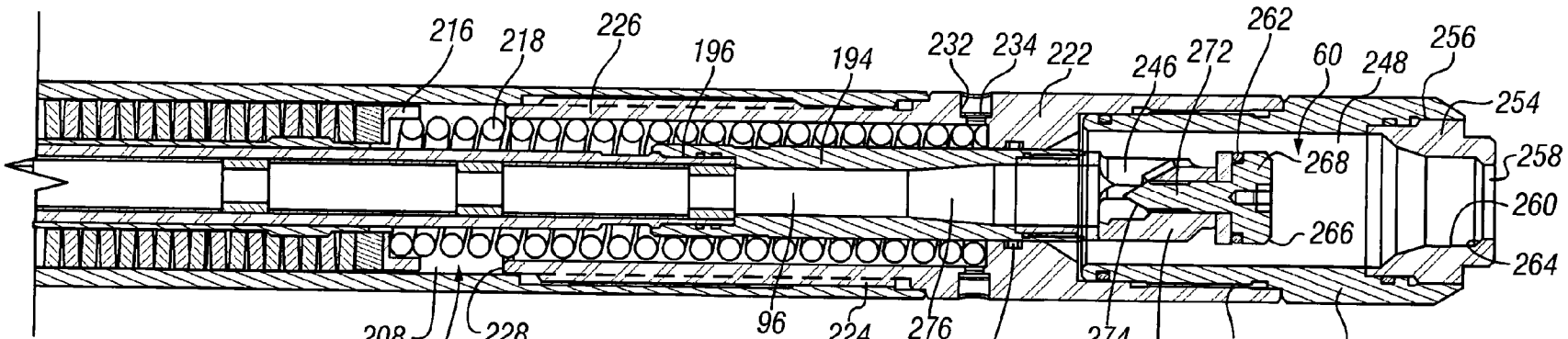

After the treatment has been completed, pressure $P_{inside}$ is reduced to a threshold value, and the disc spring stack 212 forces the power piston 152 to move upwardly. The upward movement of the power piston is transferred to the mandrel 105 through the ratcheting collet mechanism 137. After a predetermined length of travel of the tubular valve operating mandrel the valve 60 opens. When the valve opens, the differential pressure is significantly reduced and the power spring 212 quickly extends, keeping the tool open (FIGS. 11B-1 and 11B-2). In many cases the pressure created by the hydrostatic column of fluid in the coiled tubing is greater than the annulus pressure. In this case fluid falls through the dump valve orifice 220 creating a flow responsive differential pressure sufficient to keep the small coil spring compressed, but the power spring and the ratcheting collet mechanism of the mandrel 105 maintain the open condition of the valve. Once the pressures are near equal, the coil spring 218 moves the mandrel system 105 upwardly until the release sleeve 162 disengages the collet (FIG. 11B-1) and the mandrel 105 and the power piston 152 are returned to the starting point, Position 1 (FIGS. 7B-1 and 7B-2).

With the dump valve tool open (FIGS. 8B-1 and 8B-2) slurry can now be flushed out of the coiled tubing and straddle tool. During the cleanout of the coiled tubing and of the tool chassis, the indexing mechanism forces the dump valve tool to remain open and at an intermediate position. And as long as the operator keeps the flow rate above a prescribed value, the tool cannot index and will remain open regardless of the flow rate. This is an improvement on previous dump valve tools, since the dump valve tool is subject to flow responsive closure by the fluid being dumped once a predetermined flow rate has been exceeded. Also, in the previous dump valve tools, if the orifice is obstructed, the raw pressure applied may shift the tool regardless of flow rate. The multi-cycle dump valve of the present invention significantly mitigates this problem. Since the indexing J-mechanism has an intermediate operating position that allows the dump valve tool to remain open, regardless of the flow rate through the tool, significant pressure can be applied to clear the obstruction if necessary.

Once the coiled tubing and straddle tool are cleaned, the flow rate is reduced and the tool returns to Position 3 (FIGS. 7B-1 and 7B-2) ready to start another treatment cycle.

Often during a fracturing treatment the fracture will stop taking proppant. At this point the job screens out and the fracturing pressure rises rapidly. If the fracturing treatment screens out, the amount of proppant that must be dumped is also increased. An over pressure relief, (FIGS. 18A and 18B) can be incorporated in the dump valve seat so that when the differential pressure exceeds a predetermined limit the valve seat will move away from the seal of the valve element thus automatically relieving the overpressure condition. When the dump valve opens the screened out proppant is also automatically dumped through the dump valve and into the well casing below the dump valve. The overpressure relief valve shown in FIGS. 18A and 18B is a single shear relief, non-resettable design. If desired, the relief valve can be designed such that after the flow of fluid across the relieved valve is reduced the valve seat will return to its original position, ready for the next treatment cycle.

In view of the foregoing it is evident that the present invention is one well adapted to attain all of the objects and features hereinabove set forth, together with other objects and features which are inherent in the apparatus disclosed herein. As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A method for controlling downhole operation of a multi-cycle dump valve mechanism of a straddle packer tool within a well casing, said multi-cycle dump valve mechanism having a valve operating mandrel movable within a housing and supporting a dump valve element for open and closed positioning relative to a valve seat of said housing, an indexing mechanism controlling closing movement of said valve operating mandrel and an energy storage system, said method comprising:

positioning the straddle packer tool and multi-cycle dump valve mechanism at a desired location within a well casing and with said valve operating mandrel of said dump valve mechanism at a starting position with said dump valve element open;

causing flow responsive conditioning of said indexing mechanism for closing movement of said valve operating mandrel and said dump valve element;

causing flow responsive dump valve closing movement of said valve operating mandrel and storing energy in said energy storage system during said flow responsive valve closing movement with said dump valve element closed with respect to said valve seat, causing the flow of fluid through the straddle packer tool and accomplishing well treatment;

upon completion of well treatment, causing stored energy return of said valve operating mandrel to an intermediate valve open position causing dumping of fluid through said dump valve mechanism into the well casing; and with said energy storage system returning said valve operating mandrel to said starting position.

2. The method of claim 1, wherein a power piston having a ratcheting collet mechanism is disposed in releasable force transferring relation with said valve operating mandrel and said power piston is disposed in energy transferring relation with said energy storage system, said method comprising:

during flow responsive movement of said valve operating mandrel in the valve closing direction engaging said ratcheting collet mechanism with said valve operating mandrel;

transferring energy storing force from said valve operating mandrel and said power piston to said energy storage system; and utilizing said stored energy for causing valve opening movement of said valve operating mandrel against high pressure gradients and returning said valve operating mandrel to said starting position.

3. The method of claim 1, wherein said indexing mechanism is defined by an indexing sub of said valve operating mandrel, said indexing sub having an indexing slot and an indexing lug and an indexing sleeve being mounted for rotation about said indexing slot and having a tracking element engaged within said indexing slot, said indexing sleeve defining a lug movement slot, said step of causing flow responsive conditioning of said indexing mechanism comprising:

causing flow responsive linear movement of said valve operating mandrel in a valve closing direction from said starting position to an indexing position; and returning said valve operating mandrel from said indexing position and causing said indexing slot to rotate said indexing sleeve to a position aligning said lug movement slot with said indexing lug.

4. The method of claim 3, comprising:

causing flow responsive linear movement of said valve operating mandrel in a valve closing direction and moving said indexing lug through said lug movement slot of said indexing sleeve and positioning said dump valve element in valve closing relation with said valve seat.

5. The method of claim 1, wherein said indexing mechanism is defined by an indexing sub of said valve operating mandrel, said indexing sub having an indexing slot and an indexing lug and an indexing sleeve being mounted for rotation about said indexing slot and having a tracking element engaged within said indexing slot, said indexing sleeve defining a lug movement slot, said method comprising:

during flow responsive valve movement of said valve operating mandrel in the valve closing direction engaging said indexing sleeve with said indexing lug and restraining complete closure of said dump valve mechanism.

6. The method of claim 5, comprising:

indexing said dump valve mechanism for valve closure by causing rotation of said indexing sleeve to a position aligning said lug movement slot with said indexing lug and causing flow responsive movement of said valve operating mandrel to a position locating said dump valve element in seated relation with said valve seat.

7. The method of claim 2, wherein said energy storage system having a high load energy storage device having sufficient force transmitting capacity for opening said dump valve mechanism against large hydrostatic gradients and a lower load energy storage device having sufficient force transmitting capacity for returning said valve operating mandrel to said starting position, said step of storing energy in said energy storage system comprising:

establishing force transmitting engagement of said ratcheting collet mechanism with said valve operating mandrel;

during flow responsive movement of said valve operating mandrel toward valve closing position applying fluid pressure to said power piston and storing energy in said lower load energy storage device;

maintaining fluid pressure on said power piston during well treatment;

decreasing fluid pressure on said power piston sufficiently to permit opening of said dump valve by said first energy storage device; and further decreasing fluid pressure on said power piston, permitting movement of said valve operating mandrel toward said starting position by said second energy storage device.

8. The method of claim 2, wherein said ratcheting collet mechanism comprises a tubular collet sub being connected in said valve operating mandrel and defining buttress threads and said power piston having a plurality of collet fingers each having buttress threads disposed for ratcheting engagement with said buttress threads of said tubular collet sub, said method comprising:

causing pressure responsive downward movement of said power piston, with flow responsive movement of said valve operating mandrel being restrained by said indexing sleeve, causing ratcheting of said buttress threads of said plurality of collet fingers over said buttress threads of said tubular collet sub; and causing relative pressure responsive positioning of said power piston and said valve operating mandrel and maintaining valve opening force transmitting engagement of said power piston and said valve operating mandrel during said relative pressure responsive positioning.

9. A method for controlling downhole operation of a multi-cycle dump valve mechanism of a straddle packer tool, said multi-cycle dump valve mechanism having a valve operating mandrel movable within a housing and supporting a valve element for open and closed positioning relative to a valve seat of said housing, an indexing mechanism controlling closing movement of said valve operating mandrel, a power piston having a ratcheting collet mechanism and an energy storage system in force transferring relation with said power piston, said method comprising:

positioning the straddle packer tool and dump valve mechanism at a desired location within a well casing and with said valve operating mandrel of said dump valve mechanism at a starting position with said valve element open;

causing a flow responsive linear movement of said valve operating mandrel to an intermediate position and storing energy within said energy storage system;

energizing said ratcheting collet mechanism and releasably interconnecting said power piston with said valve operating mandrel;

causing further flow responsive closing movement of said valve operating mandrel to an intermediate position and with said collet mechanism transferring force from said valve operating mandrel to said power piston;

increasing flow responsive force on said valve operating mandrel and moving said valve operating mandrel to a valve closed position and causing said power piston to further load said energy storage system;

with said dump valve closed causing the flow of fluid through the straddle packer tool and accomplishing well treatment;

upon completion of well treatment, reducing application of fluid pressure to said dump valve mechanism and causing stored energy return of said dump valve mechanism to an intermediate valve open position causing dumping of fluid through said dump valve mechanism into the well casing; and with said energy storage system and said ratcheting collet mechanism returning said valve operating mandrel to said starting position.

10. The method of claim 9, wherein the energy storage system comprises a low load energy storage device and a higher load energy storage device, said method comprising:

causing fluid flow responsive development of a condition activating said low load energy storage device and moving the dump valve mechanism toward the closed position thereof and storing sufficient energy in said low load energy storage device for returning said valve operating mandrel to said starting position; and increasing fluid pressure within said dump valve mechanism to a level activating said higher load energy storage device and storing sufficient energy for overcoming any high pressure gradient and causing initial opening movement of said dump valve mechanism from said closed position.

11. The method of claim 9, wherein the first energy storage device is at least one spring having a predetermined load capacity and the second energy storage device is at least one spring having a load capacity exceeding the predetermined load capacity and a moveable mandrel is disposed in force transmitting and receiving relation with the springs of the first and second energy storage devices, said method comprising:

after predetermined flow responsive valve closing movement of said valve operating mandrel establishing driving engagement of said power piston member with said collet mechanism and applying sufficient pressure to the area of said power piston for moving said valve operating mandrel to valve closing position and storing sufficient energy in said energy storage system overcoming the force of any high pressure gradient on said valve element and causing valve opening movement of said valve operating mandrel.

12. The method of claim 9, wherein the dump valve mechanism has a valve operating mandrel supporting a valve element of said dump valve and a power piston member in force transmitting engagement with said energy storage system and a collet mechanism releasably connecting said valve operating mandrel and said power piston member, said method comprising:

after predetermined flow responsive valve closing movement of said valve operating mandrel establishing driving engagement of said power piston member with said collet mechanism and applying sufficient fluid pressure to said power piston and selectively moving said valve operating mandrel by force of said power piston member to the valve closed position and storing sufficient energy in said energy storage system for causing opening movement of said valve operating mandrel.

13. The method of claim 12, wherein a ratcheting collet mechanism establishes driving connection between said valve operating mandrel and said power piston member, said method comprising:

engaging said ratcheting collet mechanism with said valve operating mandrel during an initial portion of flow responsive valve closing movement of said valve operating mandrel;

causing pressure responsive ratcheting of said ratcheting collet mechanism and imparting power piston force to said energy storage system responsive to differential pressure; and releasing force from said storage system to said valve operating mandrel for moving said valve operating mandrel toward the open position thereof.

14. The method of claim 13, wherein an indexing mechanism is operative for position control of said valve operating mandrel and said energy storage system comprises a low load energy storage device having a load capacity causing returning movement of said valve operating mandrel and operating said indexing mechanism and a higher load energy storage device having a load capacity for causing opening movement of said valve operating mandrel under conditions of large pressure gradients, said method comprising:

during an initial portion of the closing movement of said valve operating mandrel from the open position thereof storing energy in said low load energy storage device and positioning said valve operating mandrel at an intermediate position with the dump valve mechanism open, and with said indexing mechanism preventing closure of said dump valve mechanism by flow responsive force acting on said valve operating mandrel.

15. The method of claim 13, comprising:

positioning said indexing mechanism for dump valve closure;

applying flow responsive force to said valve operating mandrel to close said dump valve; and during valve closing movement of said valve operating mandrel causing pressure responsive power piston force induced energy storage in at least one of said energy storage devices.

* * * * *